US012172794B2

(12) United States Patent
Torikai et al.

(10) Patent No.: US 12,172,794 B2
(45) Date of Patent: Dec. 24, 2024

(54) CURL CORRECTING DEVICE AND BLISTER PACKAGING MACHINE

(71) Applicant: Maruho Hatsujyo Kogyo Co., Ltd., Kyoto (JP)

(72) Inventors: Hideteru Torikai, Natan (JP); Tetsuya Kannan, Natan (JP)

(73) Assignee: MARUHO HATSUJYO KOGYO CO., LTD., Kyoto (JP)

( * ) Notice: Subject to any disclaimer, the term of this patent is extended or adjusted under 35 U.S.C. 154(b) by 210 days.

(21) Appl. No.: 17/794,834

(22) PCT Filed: Jan. 20, 2021

(86) PCT No.: PCT/JP2021/001806
§ 371 (c)(1),
(2) Date: Jul. 22, 2022

(87) PCT Pub. No.: WO2021/149706
PCT Pub. Date: Jul. 29, 2021

(65) Prior Publication Data

US 2023/0079106 A1 Mar. 16, 2023

(30) Foreign Application Priority Data

Jan. 22, 2020 (JP) ..... 2020-008517

(51) Int. Cl.
*B65B 9/04* (2006.01)
*B65H 29/70* (2006.01)

(52) U.S. Cl.
CPC ..... *B65B 9/045* (2013.01); *B65H 29/70* (2013.01)

(58) Field of Classification Search
CPC ..... B65B 61/24; B65B 9/045; B65B 9/04; B65H 29/70
See application file for complete search history.

(56) References Cited

U.S. PATENT DOCUMENTS 4,693,057 A * 9/1987 Rittinger ..... B65B 35/08 53/247
4,750,318 A * 6/1988 Matsuzawa ..... B65B 61/06 83/882
5,555,083 A * 9/1996 Kuo ..... B65H 5/025 162/197

FOREIGN PATENT DOCUMENTS

JP S6138001 U 8/1984
JP S63110125 A 10/1986
JP 04114849 A 4/1992
JP H04114849 A * 4/1992
(Continued)

*Primary Examiner* — Andrew M Tecco
(74) *Attorney, Agent, or Firm* — Ohlandt, Greeley and Perle, L.L.P.

(57) ABSTRACT

A curl correcting device (1) includes a pressing unit (12) disposed on a +Z direction side of a blister film, and pressing, by a pressing member (121), an area including a pocket in the blister film and including both end portions of the blister film in an X-axis direction; and a support member (131) supporting the blister film in a state of abutting on a −Z direction side on both sides of an area pressed by the pressing member (121) in a Y-axis direction of the blister film. A recess (121*a*) having a width in the X-axis direction greater than a width in the X-axis direction of the pocket and penetrating the pressing member (121) in the Y-axis direction is formed at a location corresponding to the pocket of the blister film on the −Z direction side of the pressing member (121).

13 Claims, 30 Drawing Sheets

(56) References Cited

FOREIGN PATENT DOCUMENTS

| | | | |
|---|---|---|---|
| JP | 2003081206 | A | 3/2003 |
| JP | 2019006482 | A | 1/2019 |

* cited by examiner

CURL CORRECTING DEVICE AND BLISTER PACKAGING MACHINE

TECHNICAL FIELD

The present disclosure relates to a curl correcting device and a blister packaging machine.

BACKGROUND ART

There is proposed a curl correcting mechanism in a blister packaging machine that manufactures a rectangular blister pack by punching a blister-packaged strip-shaped sheet member by a punch die (see, for example, Patent Literature 1). The curl correcting mechanism includes a curl correcting plate that presses a position between blisters of the sheet member before being punched by the punch die, in a linear shape along a direction of a curl occurring in a rectangular blister pack; and a curl correcting groove that receives a distal end portion of the curl correcting plate via the sheet member.

CITATION LIST

Patent Literature

Patent Literature 1: Unexamined Japanese Patent Application Publication No. 2019-006482

SUMMARY OF INVENTION

Technical Problem

In the meantime, in the blister packaging machine described in Patent Literature 1, the throughput of blister packs is affected by a processing speed of a curl correcting process by the curl correcting mechanism. It is thus required to enhance the processing speed of the curl correcting process by the curl correcting mechanism.

The present disclosure has been made in consideration of the above circumstances, and the objective of the disclosure is to provide a curl correcting device and a blister packaging machine, which can enhance a throughput in the manufacture of blister packs.

Solution to Problem

In order to achieve the above objective, a curl correcting device according to the present disclosure is a curl correcting device that corrects a curl occurring in a blister film with a strip shape, pockets for accommodating works being formed in the blister film and being arranged in a first direction along an extending direction of the blister film, the curl correcting device including:

a pressing unit disposed on one surface side in a thickness direction of the blister film, and pressing, by a pressing member, a first area including at least a part of the pockets in the blister film and including both end portions of the blister film in a second direction perpendicular to the first direction and the thickness direction of the blister film, or a second area located between two mutually neighboring pockets in the first direction in the blister film and including both end portions of the blister film in the second direction; and a support member supporting the blister film in a state of abutting on the other surface side in the thickness direction of the blister film on both sides of a part pressed by the pressing member in the first direction of the blister film, wherein a recess having a width in the second direction greater than a width in the second direction of the pocket and penetrating the pressing member in the first direction is formed at a location corresponding to the pocket on the blister film side of the pressing member.

Advantageous Effects of Invention

According to the present disclosure, the recess having the width in the second direction, which is greater than the width in the second direction of the pocket, and penetrating the pressing member in the first direction, is formed at a location corresponding to the pocket on the blister film side of the pressing member. Thereby, when the blister film is conveyed to the downstream side, the distance of the distal end portion on the blister film side of the pressing member from the blister film can be made less than the height of the pocket in the thickness direction of the blister film. Accordingly, since the distance of movement of the pressing member in the thickness direction of the blister film at the time of pressing the blister film by the pressing member can be shortened, the time needed for the curl correcting process of the blister film can be shortened by that much. Therefore, the throughput in the manufacture of blister packs using the blister packaging machine can be enhanced.

BRIEF DESCRIPTION OF DRAWINGS

FIG. TA is a perspective view of a part of a blister packaging machine according to Embodiment 1 of the present disclosure.

DESCRIPTION OF EMBODIMENTS

Embodiment 1

Figure 1A:
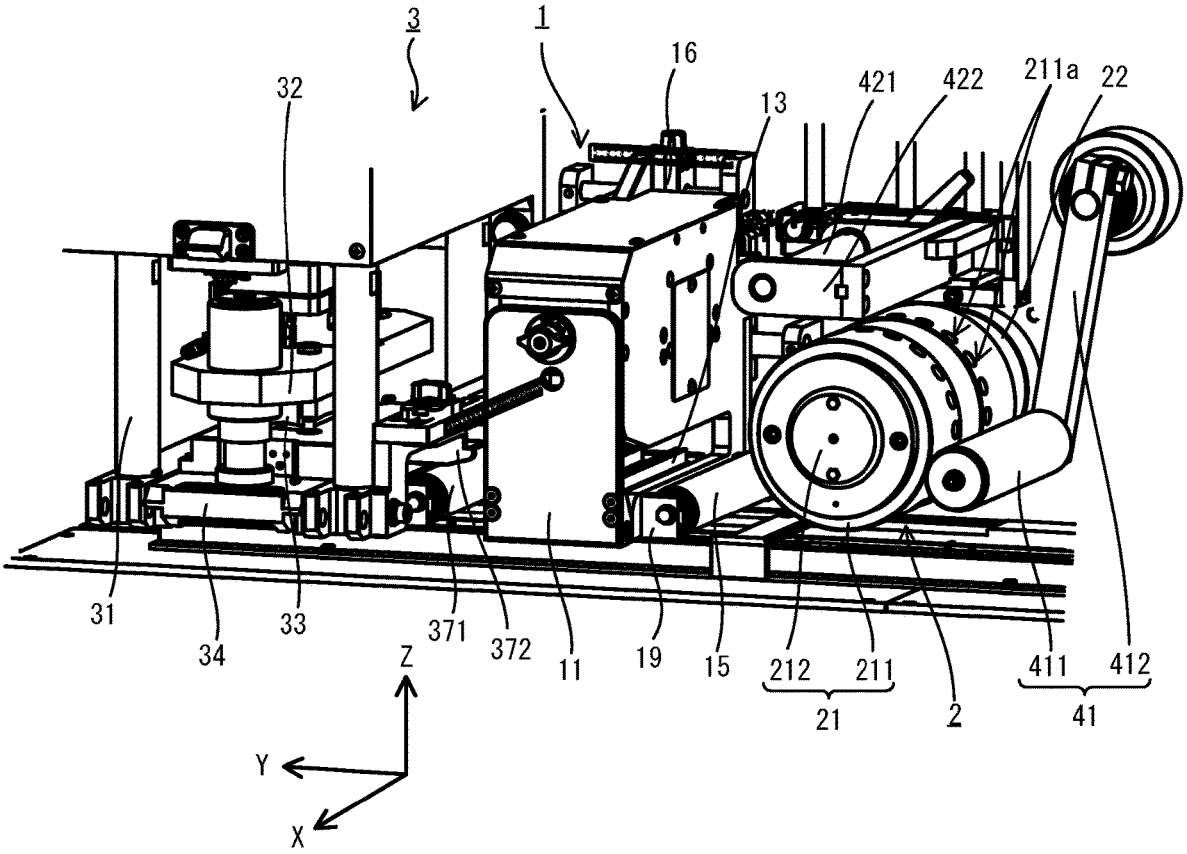
FIG. 1B is a front view of a part of the blister packaging machine according to Embodiment 1.

Hereinafter, a curl correcting device according to an embodiment of the present disclosure is described with reference to the drawings. The curl correcting device according to the present embodiment is a curl correcting device for correcting a curl occurring in a blister film with a strip shape, pockets for accommodating works being formed in the blister film and being arranged in a first direction along an extending direction of the blister film. The curl correcting device includes a pressing unit and a film support unit. The pressing unit is disposed on one surface side in a thickness direction of the blister film, and presses, by a pressing member, a first area including at least a part of the pockets in the blister film and including both end portions of the blister film in a second direction perpendicular to the first direction and the thickness direction of the blister film, or a second area located between two mutually neighboring pockets in the first direction in the blister film and including both end portions of the blister film in the second direction. In addition, the film support unit supports the blister film in a state of abutting on the other surface side in the thickness direction of the blister film on both sides of a part pressed by the pressing member in the first direction of the blister film. Furthermore, a recess having a width in the second direction greater than a width in the second direction of the pocket is formed at a location corresponding to the pocket on the blister film side of the pressing member.

A blister packaging machine according to the present embodiment arms at manufacturing a blister pack including a container film in which a pocket for accommodating an article is formed, and a cover film that is attached to the container film in such a manner as to close the pocket. Here, examples of a work include a tablet, food, an electronic component, and medical equipment. The blister packaging machine according to the present embodiment includes a forming device (not illustrated) and a sealing device (not illustrated). The forming device produces a container film by forming a pocket, which contains a work, in a strip-shaped material film formed of a thermoplastic resin. The sealing device produces a blister film by attaching a strip-shaped cover film to the container film in such a manner as to cover the opening of the pocket in the state in which the work is filled in the pocket, and sealing the pocket. In addition, as illustrated in FIG. TA and FIG. 1B, the blister packaging machine includes a convey device 2 that conveys the blister film, which is produced by the sealing device, to the downstream side; a punching device 3 that punches a blister pack (not illustrated) from the blister film; and a curl correcting device 1 intervening between the convey device 2 and the punching device 3. Besides, the blister packaging machine includes a guide roller 421 that guides the blister film to the convey device 2; and a roller supporter 422 that rotatably supports the guide roller 421.

The punching device 3 is a device that punches a blister pack from the blister film. The punching device 3 includes a die unit 33 disposed on a −Z direction side of the blister film that is introduced into the punching device 3; and a punch unit 32 disposed on a +Z direction side of the blister film. In addition, the punching device 3 includes a die driver 34 that supports the die unit 33 and drives the die unit 33 in a vertical direction; and a pack recoverer (not illustrated) that recovers the blister pack punched from the blister film. Moreover, the punching device 3 includes a device body 31 that supports the die unit 33, punch unit 32 and die driver 34 together. The punch unit 32 includes a punch (not illustrated) for punching the blister pack from the blister film. In addition, the die unit 33 is provided with an opening (not illustrated) for dropping the blister pack, which is punched by the punch, into the pack recoverer. Furthermore, the 10 punching device 3 includes a roller 371 and a film position restriction member 372 for keeping, at a preset height, the height of the blister film in a Z-axis direction at a time when the blister film is introduced into the punching device 3.

The convey device 2 includes a film feed roller 21 around which a blister film is wound, and a roller driver 22. The film feed roller 21 includes a wheel 211, a shaft 212 that axially supports the wheel 211. On the wheel 211, a plurality of recesses 21Ta, in which pockets of the blister film are engaged, is juxtaposed along the circumferential direction of the wheel 211. The convey device 2 conveys the blister film to the downstream side by rotating the film feed roller 21 in the state in which pockets of the blister film are engaged in some of the recesses of the film feed roller 21. The roller driver 22 intermittently rotates the film feed roller 21 in units of a preset rotational angle in the state in which the pockets of the blister film are engaged in some of the recesses 211*a* of the wheel 211. Thereby, the blister film is intermittently fed to the punching device 3 in units of a preset reference distance. In addition, a film presser 41 for preventing the blister film from separating from the film feed roller 21 while the blister film is being conveyed is disposed on a −Y direction side of the convey device 2. The film presser 41 includes a roller 411 that comes in contact with the blister film, which is wound around the film feed roller 21, from a +Y direction side of the film feed roller 21; and an arm 412 having an elongated shape and having one end portion in the longitudinal direction attached to the roller 411. In addition, the film presser 41 includes an arm driver (not illustrated)

that rotatably supports the other end portion in the longitudinal direction of the arm 412 and urges the one end portion of the arm 412 toward a direction of pressing on the film feed roller 21.

Figure 2A:
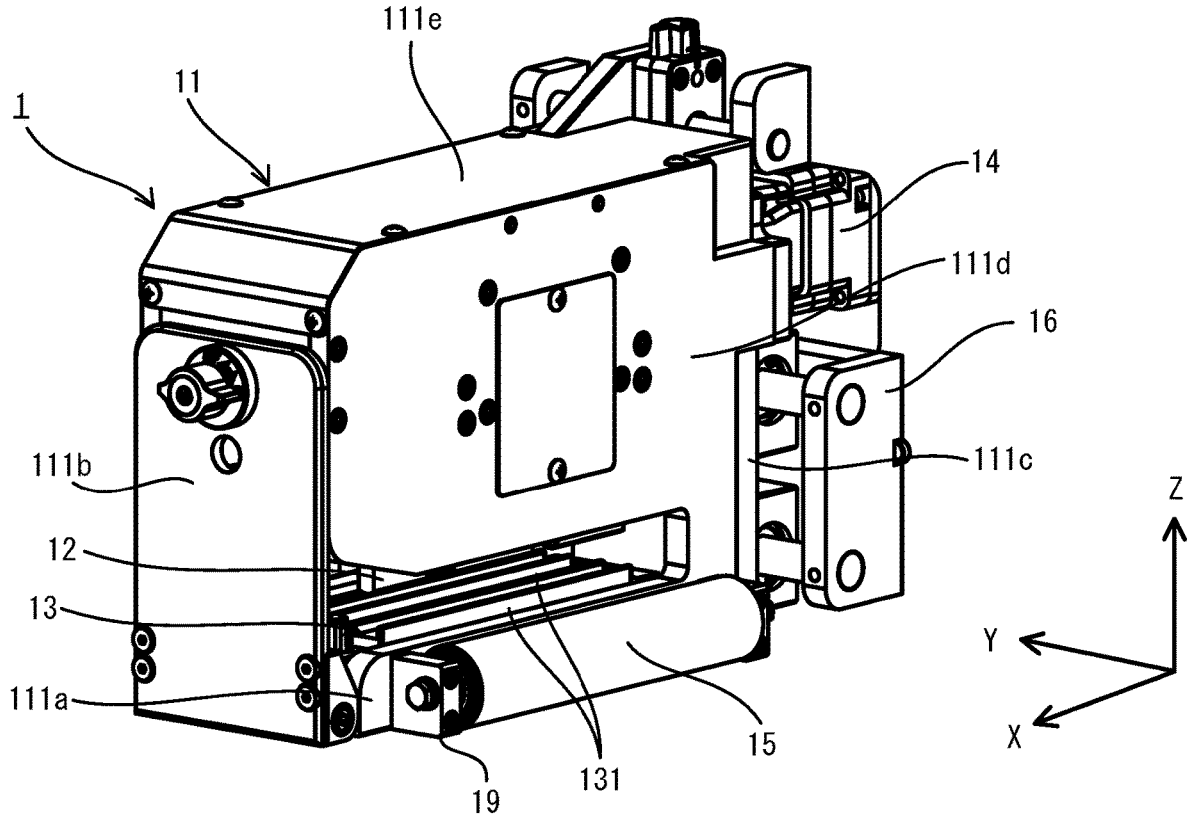
FIG. 2A is a perspective view of a curl correcting device according to Embodiment 1.

As illustrated in FIG. 2A, the curl correcting device 1 includes a device body 11; a pressing unit 12 that presses the blister film from the +Z direction side; a film support unit 13 that supports the blister film from the −Z direction side; and a driver 14 that drives the pressing unit 12. In addition, the curl correcting device 1 includes a guide roller 15 that guides the blister film into the curl correcting device 1; and a fixing member 16 for fixing the device body 11 to a machine body of the blister packaging machine. The device body 11 includes abase member 111*a*; aside wall 111*b* fixed to an end portion on a +X direction side of the base member 111*a* and extending to the +Z direction side; and a side wall 111*c* fixed to an end portion on a −X direction side of the base member 111*a* and extending to the +Z direction side. In addition, the device body 11 includes two side walls 111*d* disposed to be spaced apart in the Y-axis direction and each having both end portions in the X-axis direction fixed to the side walls 111*b* and 111*c*; and a cover 111*e* disposed in such a manner as to cover the +Z direction side of a region surrounded by the base member 111*a* and the side walls 111*b*, 111*c* and 111*d*. The side wall 111*d* is provided with a guide block 112 through which a guide bar 174 to be described later is inserted; and two bearing supporters 113 that support outer rings of two bearings 151. Besides, a driver supporter 114 that supports the driver 14 is provided on an end portion on the +Z direction side in the side wall 111*c*.

Figure 2B:
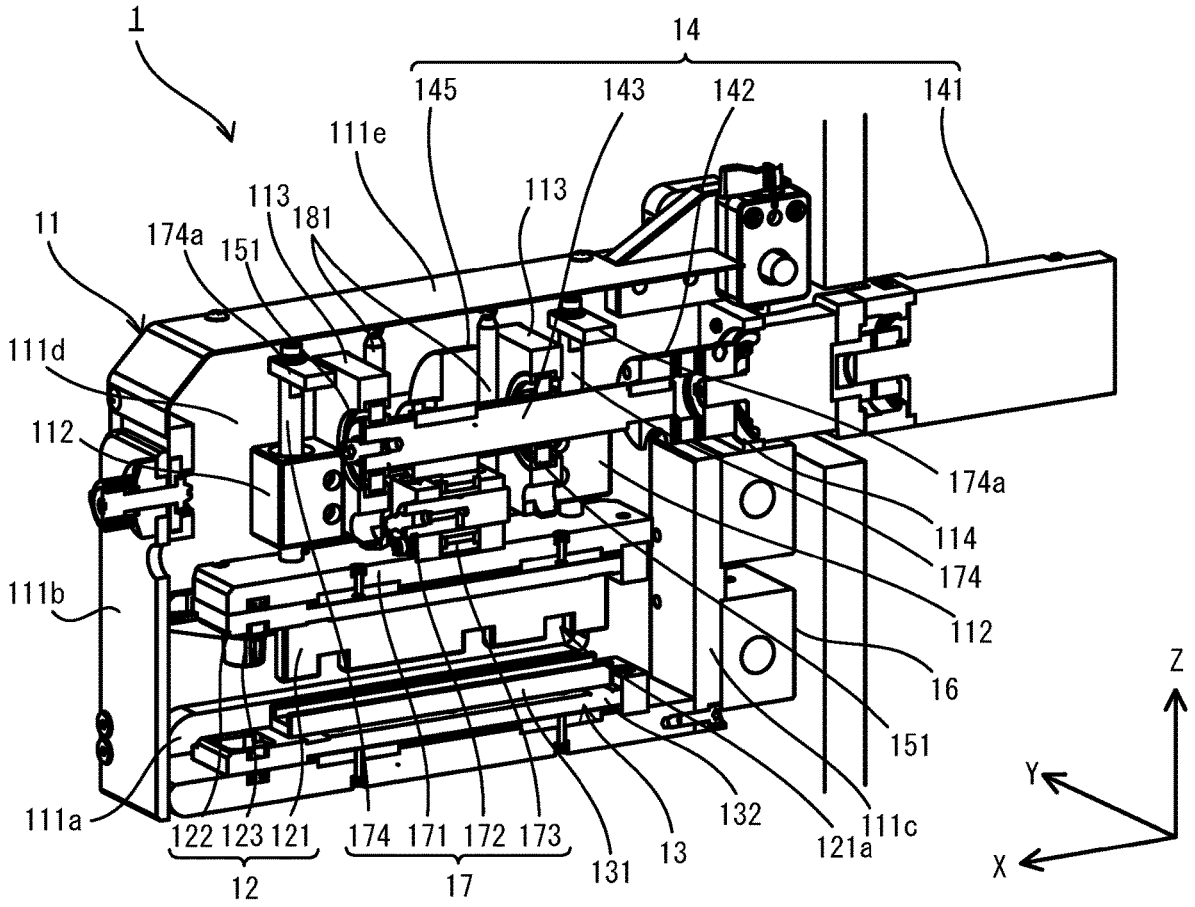
FIG. 2B is a cross-sectional perspective view of the curl correcting device according to Embodiment 1.

As illustrated in FIG. 2B, the driver 14 includes a cam 145 for driving the pressing unit 12 along the Z-axis direction; a shaft 143 that pivotally supports the cam 145; a motor 141; and a coupling member 142 that couples the motor 141 and the shaft 143. The shaft 143 is fixed to inner rings of the two bearings 151. Thereby, the shaft 143 is rotatable, relative to the device body 11, around a center axis along the longitudinal direction of the device body 11. Then, if the shaft 143 is rotated by the motor 141, the cam 145 rotates around the center axis along the longitudinal direction of the shaft 143. The motor 141 is fixed to the driver supporter 114 of the device body 11.

The pressing unit 12 is fixed to a transmission member 17 for transmitting a driving force from the driver 14 to the pressing unit 12. The transmission member 17 includes a main body 171 having an elongated shape and disposed such that the longitudinal direction thereof extends along the X-axis direction; a bearing 173 disposed on the +Z direction side in a central portion of the main body 171; and a bearing supporter 172 fixed to the main body 171 and supporting an inner ring of the bearing 173. The cam 145 of the driver 14 abuts on an outer ring of the bearing 173. Then, if the cam 145 rotates, the transmission member 17 and the pressing member 121 fixed to the transmission member 17 repeat a reciprocal movement along the Z-axis direction in accordance with the rotation. In addition, the transmission member 17 includes guide bars 174 that extend from both end portions in the longitudinal direction of the main body 171 toward the +Z direction side and are inserted in guide blocks 112 of the device body 11. A stopper 174*a* that restricts the movement in the −Z direction of the guide bar 174 is provided on an end portion on the +Z direction side of the guide bar 174. Furthermore, the transmission member 17 is urged in the +Z direction by two elongated coil springs 181. The coil spring 181 is disposed such that the longitudinal direction thereof extends along the Z-axis direction, and one end portion thereof in the longitudinal direction is fixed to the main body 171 and the other end portion thereof is fixed to an inner wall of the cover 111*e* of the device body 11.

Figure 3A:
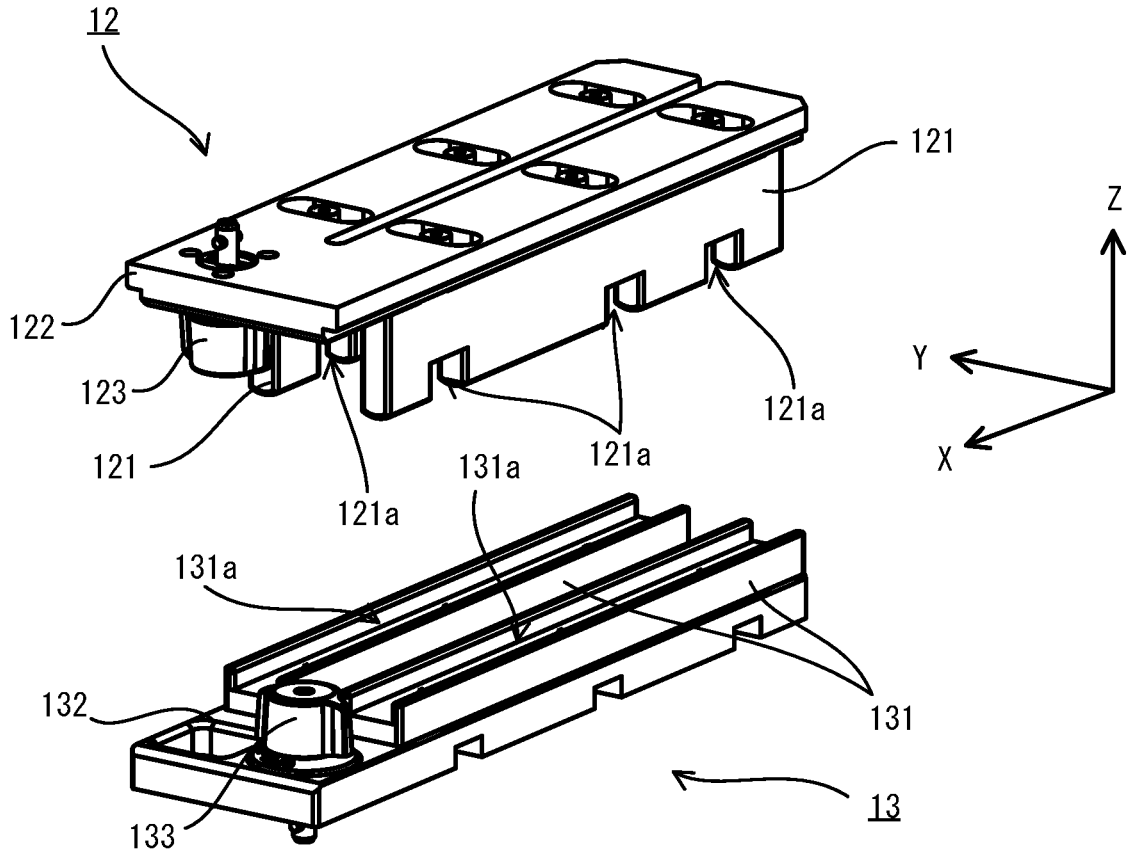
FIG. 3A is a perspective view illustrating a pressing unit and a film support unit according to Embodiment 1.
Figure 3B:
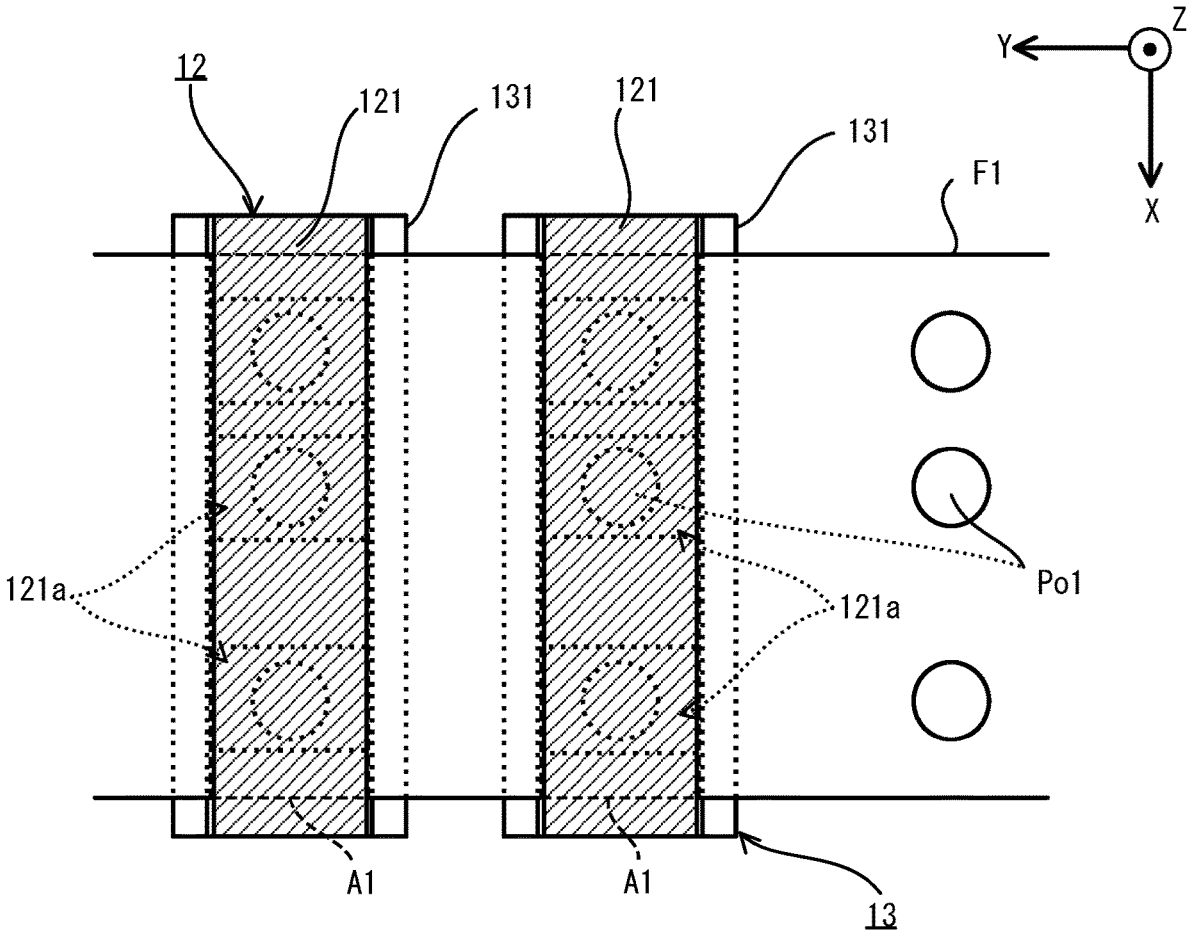
FIG. 3B is a schematic cross-sectional view of a part of the curl correcting device according to Embodiment 1.
Figure 4A:
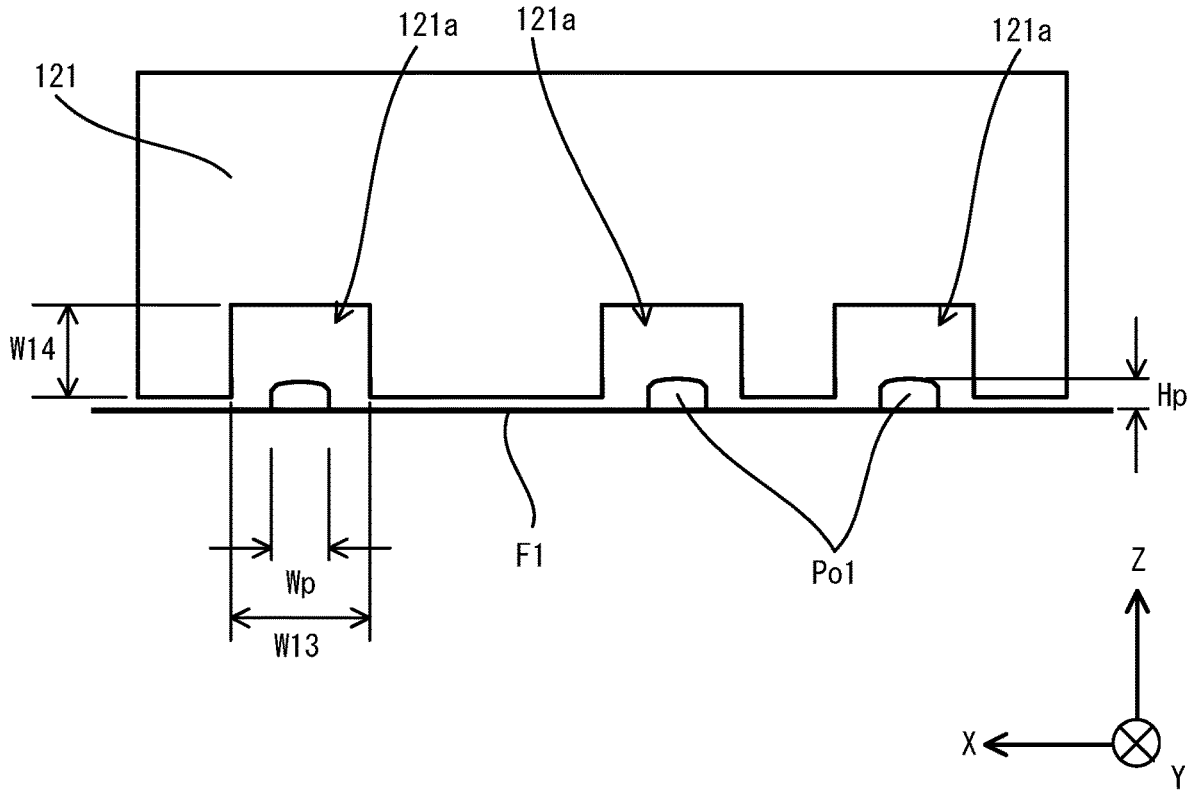
FIG. 4A is a schematic front view of a part of the curl correcting device according to Embodiment 1.
Figure 4B:
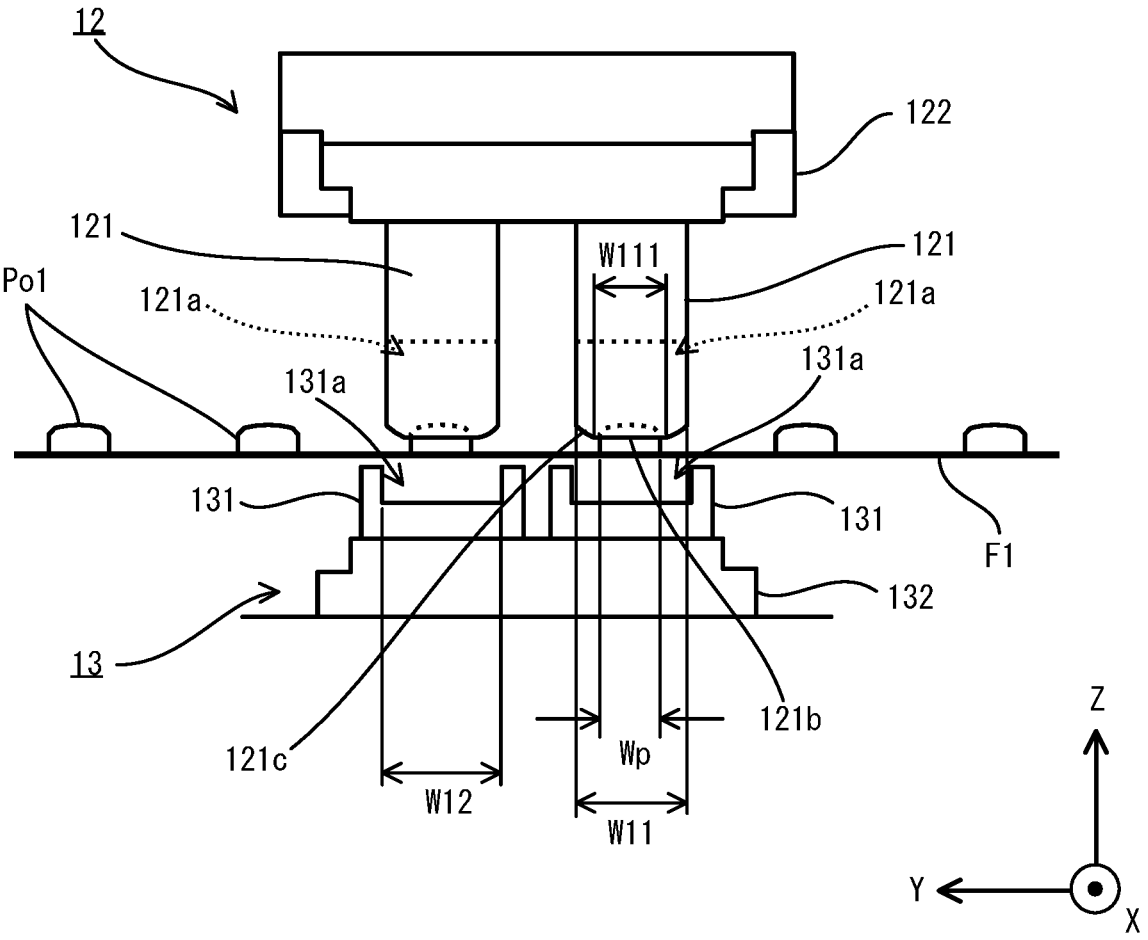
FIG. 4B is a schematic side view of a part of the curl correcting device according to Embodiment 1.

In addition, as illustrated in FIG. 3A, the pressing unit 12 includes a base portion 122 having an elongated rectangular plate shape and disposed such that the thickness direction thereof extends in the Z-axis direction; and two pressing members 121 each having an elongated rectangular plate shape and erectingly provided such that the longitudinal direction thereof extends in the Z-axis direction on the −Z direction side of the base portion 122. Besides, the pressing unit 12 includes a fixing member 123 for fixing the base portion 122 to the transmission member 17. The pressing unit 12 presses an area A1 illustrated, for example, in FIG. 3B, by the pressing member 121. Here, the area A1 corresponds to a first area including pockets Po1 in a blister film F1 and includes both end portions of the blister film F1 in the X-axis direction. As illustrated in FIG. 4A, in the pressing member 121, three recesses 121*a* each having a rectangular shape as viewed from a direction along the Y-axis direction and penetrating the pressing member 121 in the Y-axis direction are formed. Each recess 121*a* is formed at a location corresponding to the pocket Po1 on the −Z direction side of the pressing member 121 in the state in which the blister film F1 is disposed on the −Z direction side of the pressing member 121. In addition, a width W13 in the X-axis direction of the recess 121*a* is set to be greater than a width Wp in the X-axis direction of the pocket Po1. Besides, a depth W14 of the recess 121*a* is set to be greater than a height Hp in the thickness direction of the blister film F1, that is, in the Z-axis direction, of the pocket Po1 of the blister film F1. Moreover, as illustrated in FIG. 4B, a flat portion 121*b* formed of a flat surface perpendicular to the Z-axis direction, and curved portions 121*c* curved in regard to the Y-axis direction at both end portions in the Y-axis direction of the flat portion 121*b*, are formed on an end portion on the −Z direction side of the pressing member 121. Furthermore, a thickness W11 of the end portion on the −Z direction side of the pressing member 121 and a width W111 in the Y-axis direction of the flat portion 121*b* are set to be greater than a width Wp in the Y-axis direction of the pocket Po1 of the blister film F1. In addition, when the material of the blister film F1 is polyvinyl chloride or polypropylene and a sheet portion thereof has a thickness of 0.2 mm to 0.3 mm, it is preferable that a radius of curvature of the curved portion 121*c* is set to 6 mm or more. If the radius of curvature of the curved portion 121*c* is less than 6 mm, there is concern that the blister film F1 is bent and the appearance thereof deteriorates.

Referring back to FIG. 3A, the film support unit 13 includes a base portion 132 having an elongated rectangular plate shape and disposed such that the thickness direction thereof extends in the Z-axis direction; and two support members 131 each having an elongated shape and erectingly provided such that the longitudinal direction thereof extends in the Z-axis direction on the +Z direction side of the base portion 132. In addition, the film support unit 13 includes a fixing member 133 for fixing the base portion 122 to the transmission member 17. On the +Z direction side of the support member 131, grooves 131*a*, which extend in the X-axis direction and receive end portions on the −Z direction side of the pressing members 121, are formed. Here, the support member 131 is installed such that when the pressing member 121 is disposed most to the −Z direction side by the rotating cam 145 of the driver 14, the end portion on the −Z direction side of the pressing member 121 is disposed near a bottom portion of the groove 131*a*. In addition, the support member 131 supports the blister film F1 in the state in which portions on the Y direction sides of the groove 131*a* are abutted on the −Z direction side of the blister film F1 on both sides of the area A1 pressed by the pressing member 121 in the Y-axis direction of the blister film F1. A width W12 in the Y-axis direction of the groove 131*a* is set to be greater than a width W11 of the end portion on the −Z direction side of the pressing member 121 by at least a length corresponding to double the thickness of the blister film F1.

Figure 1B:
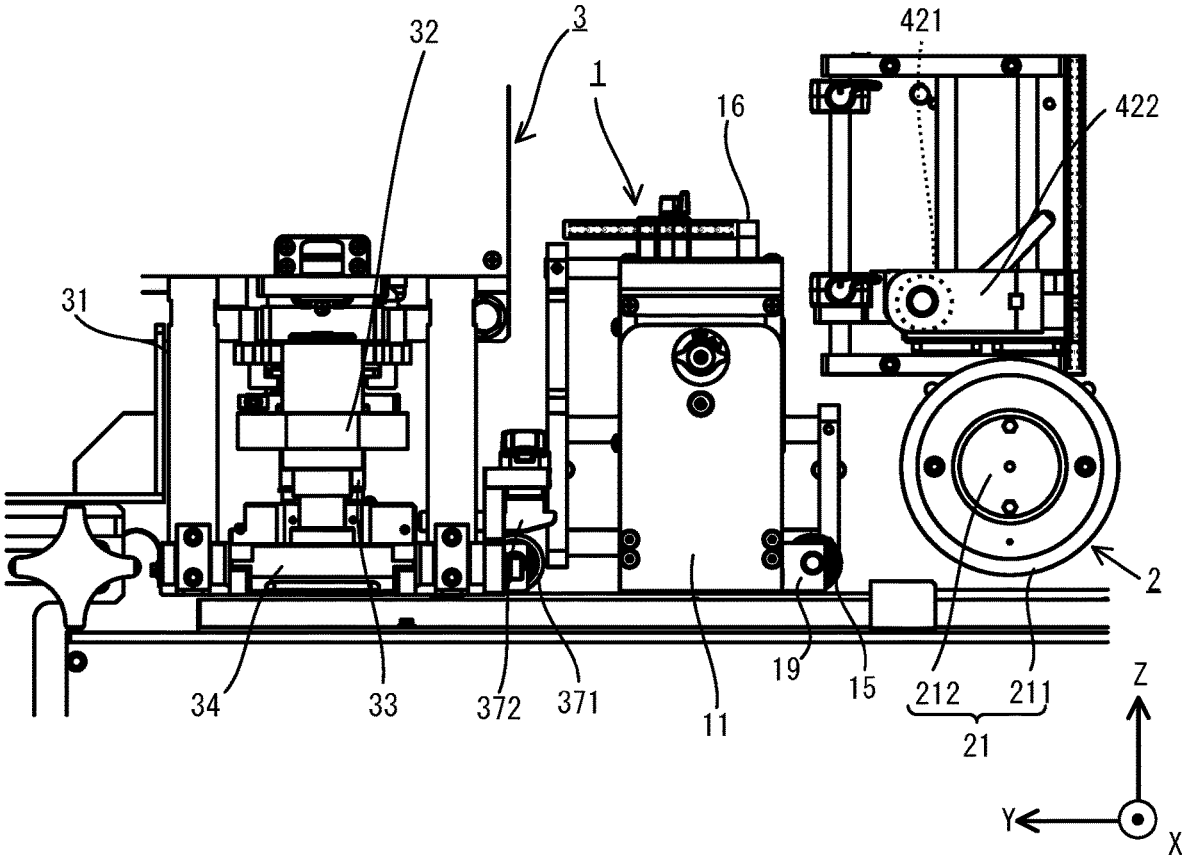

As illustrated in FIG. 1A, the guide roller 15 is supported by a roller supporter 19 fixed to the −Y direction side of the base member 111*a* of the device body 11, such that the guide roller 15 is rotatable around a rotational axis along the X-axis direction.

Figure 5A:
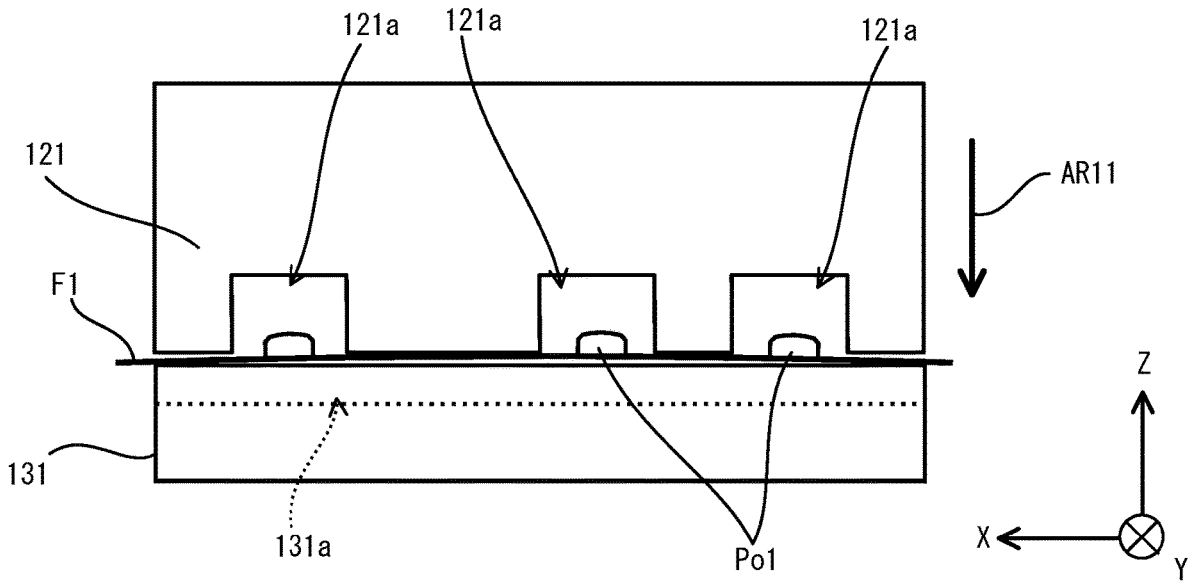
FIG. 5A is a view illustrating a scene in which the curl correcting device according to Embodiment 1 lowers a pressing member.
Figure 5B:
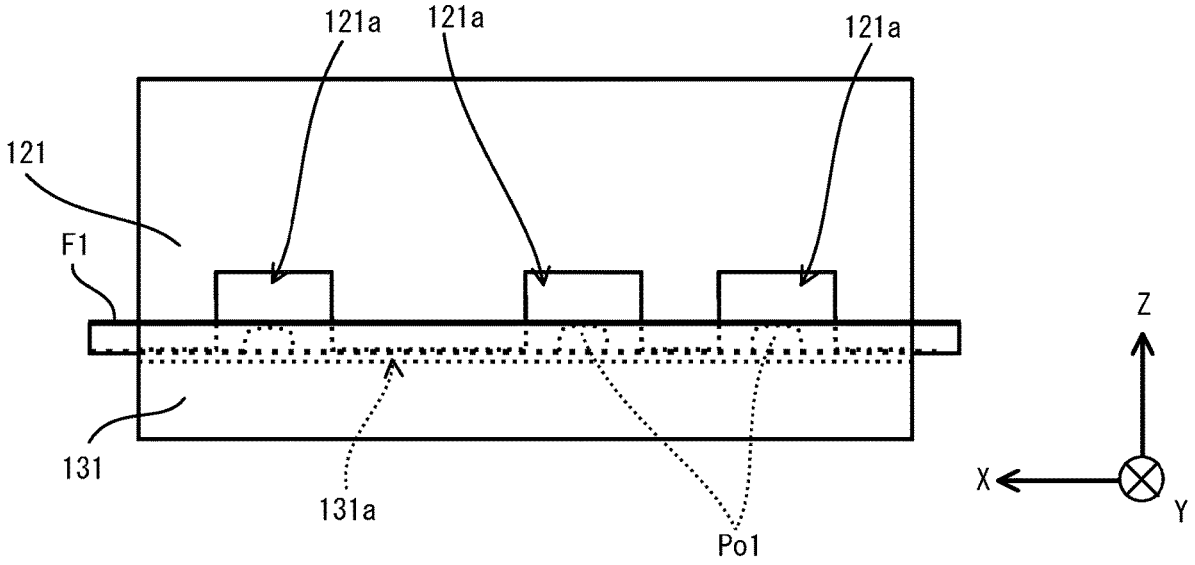
FIG. 5B is a side view illustrating a state in which the curl correcting device according to Embodiment 1 presses a lower end portion of the pressing member on a blister film.
Figure 5C:
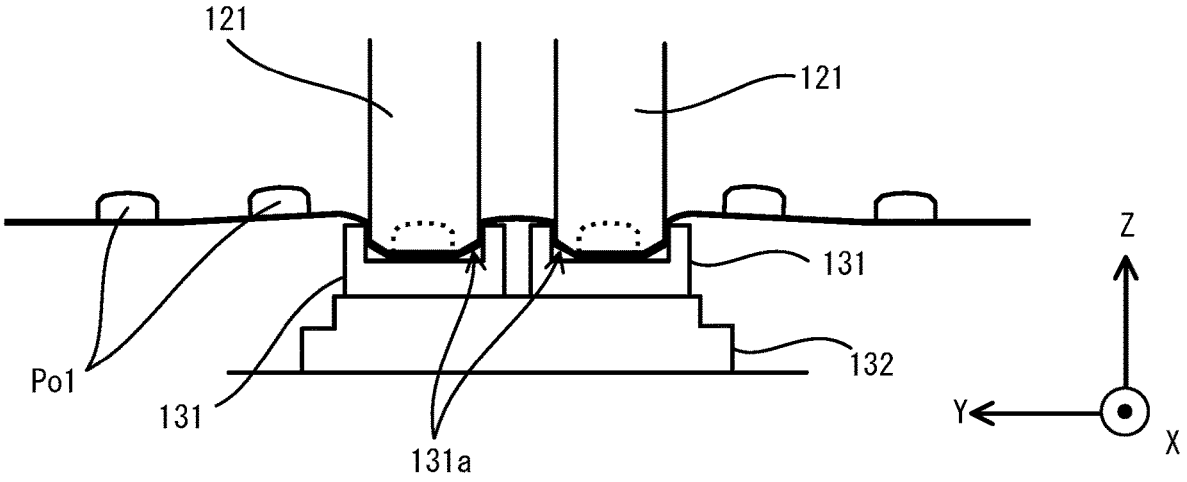
FIG. 5C is a front view illustrating a state in which the curl correcting device according to Embodiment 1 presses the lower end portion of the pressing member on the blister film.
Figure 6:
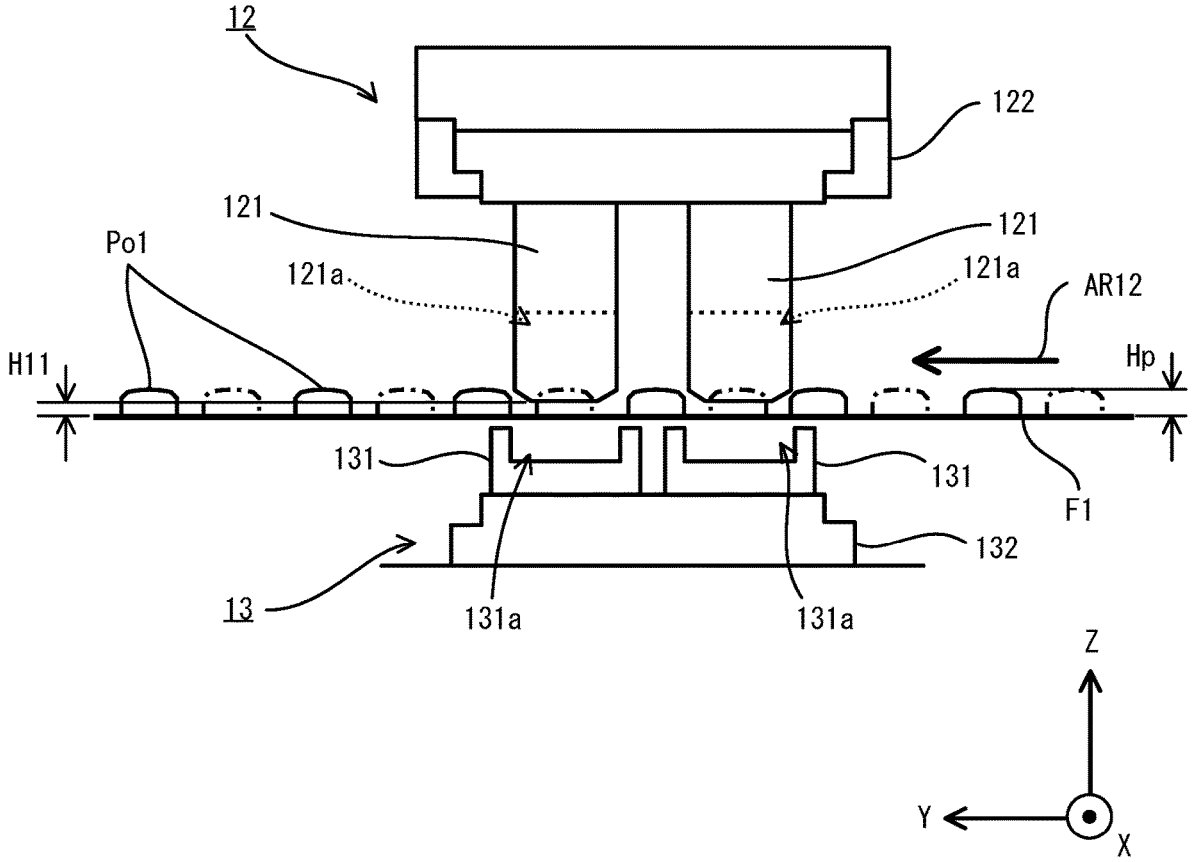
FIG. 6 is a front view illustrating a scene of conveying a blister film in connection with the curl correcting device according to Embodiment 1.

An operation of the curl correcting device 1 according to the present embodiment is now described. For example, as illustrated in FIG. 5A, when a curl of the blister film F1 occurs, which curves in a direction perpendicular to an extending direction of the blister film F1, that is, in the X-axis direction, the curl correcting device 1 corrects the curl. To begin with, in the state in which the blister film F1 is placed on the +Z direction side of the support member 131, the pressing member 121 moves to the −Z direction side, as indicated by an arrow AR11, and approaches the support member 131. Then, as illustrated in FIG. 5B and FIG. 5C, the end portion on the −Z direction side of the pressing member 121 advances into a depth side of the groove 131*a* of the support member 131, thereby pulling the blister film F1 into the inside of the groove 131*a*. Thereby, such a curl curving along the Y-axis direction of the blister film F1 as to cancel the curl curving along the X axis of the blister film F1 can be caused to occur, and the curl curving along the X-axis direction can be eliminated. Next, the pressing member 121 is released from the blister film F1 by moving the pressing member 121 in the +Z direction. At this time, as illustrated in FIG. 6, a shortest distance H11 between the end portion on the −Z direction side of the pressing member 121 and the blister film F1 is set to be less than the height Hp in the Z-axis direction of the pocket Po1. In this state, as indicated by an arrow AR12 in FIG. 6, the blister film F1 is conveyed in the +Y direction. At this time, the pocket Po1 passes through the inside of the recess 121*a* of the pressing member 121.

As described above, according to the curl correcting device 1 relating to the present embodiment, the recess 121*a* having the width W13 in the X-axis direction, which is greater than the width Wp in the X-axis direction of the pocket Po, and penetrating the pressing member 121 in the Y-axis direction, is formed at a location corresponding to the pocket Po1 of the blister film F1 on the −Z direction side of the pressing member 121. Thereby, when the blister film F1 is conveyed to the downstream side, that is, to the +Y direction side, the distance H11 of the distal end portion on the −Z direction side of the pressing member 121 from the blister film F1 can be made less than the height Hp in the Z-axis direction of the pocket Po. Accordingly, since the distance of movement in the Z-axis direction of the pressing member 121 at the time of pressing the blister film F1 by the pressing member 121 can be shortened, the time needed for the curl correcting process of the blister film F1 can be shortened by that much. Therefore, the throughput in the manufacture of blister packs using the blister packaging machine can be enhanced.

In the meantime, when the blister film F1 is formed of a material with a high contractility, there is concern that the size of a curl occurring in the blister film F1 becomes greater. In connection with this, according to the curl correcting device 1 relating to the present embodiment, when a curl curving in a convex shape in an unintended direction along the X-axis direction occurs, a curl curving along the Y-axis direction in such a direction as to cancel this curl is caused to occur, and the amount of the curl curving in the convex shape in the unintended direction can be reduced. Accordingly, for example, in a punching step of punching the blister pack by the punching device 3 after the curl correcting step by the curl correcting device 1, the occurrence of a trouble, such as a displacement of the punch position due to the curl, can be suppressed.

Embodiment 2

A pressing unit according to the present embodiment is disposed on one surface side in the thickness direction of a blister film, and presses, by a pressing member, a second area that is located between two mutually neighboring pockets in the blister film in the extending direction of the blister film, and that includes both end portions of the 20 blister film in a direction perpendicular to the extending direction and the thickness direction of the blister film. On the other hand, a support member supports the blister film in the state in which the support member abuts on the other surface side in the thickness direction of the blister film on both sides of a portion pressed by the pressing member in the extending direction of the blister film.

Figure 7A:
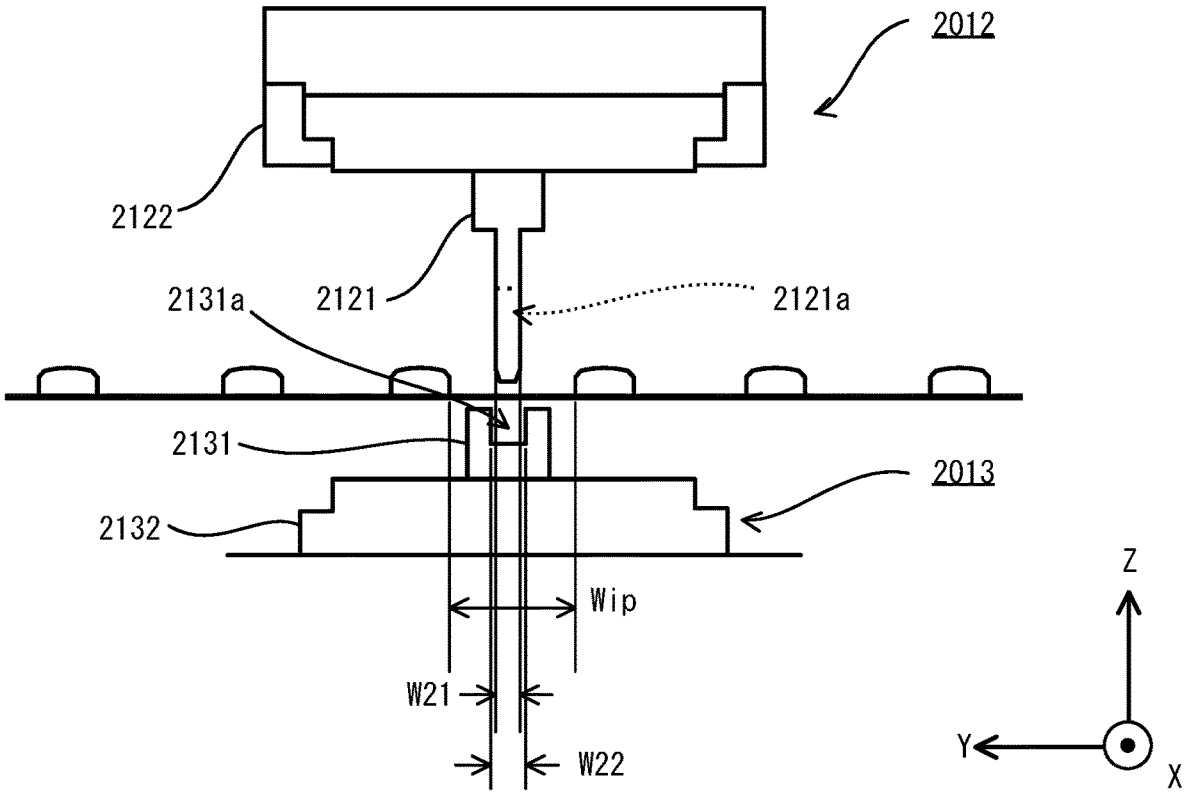
FIG. 7A is a front view of a part of a curl correcting device according to Embodiment 2.
Figure 7B:
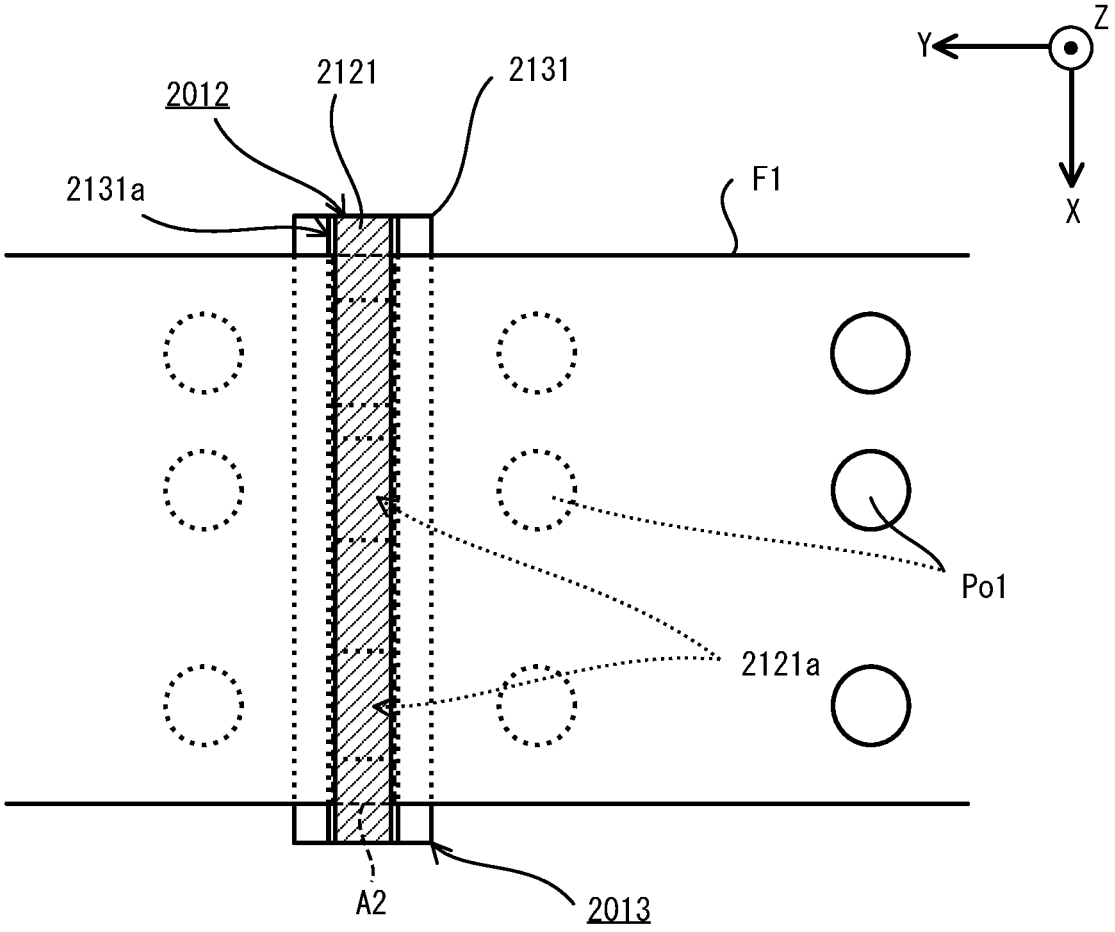
FIG. 7B is a cross-sectional view of a part of the curl correcting device according to Embodiment 2.
Figure 8A:
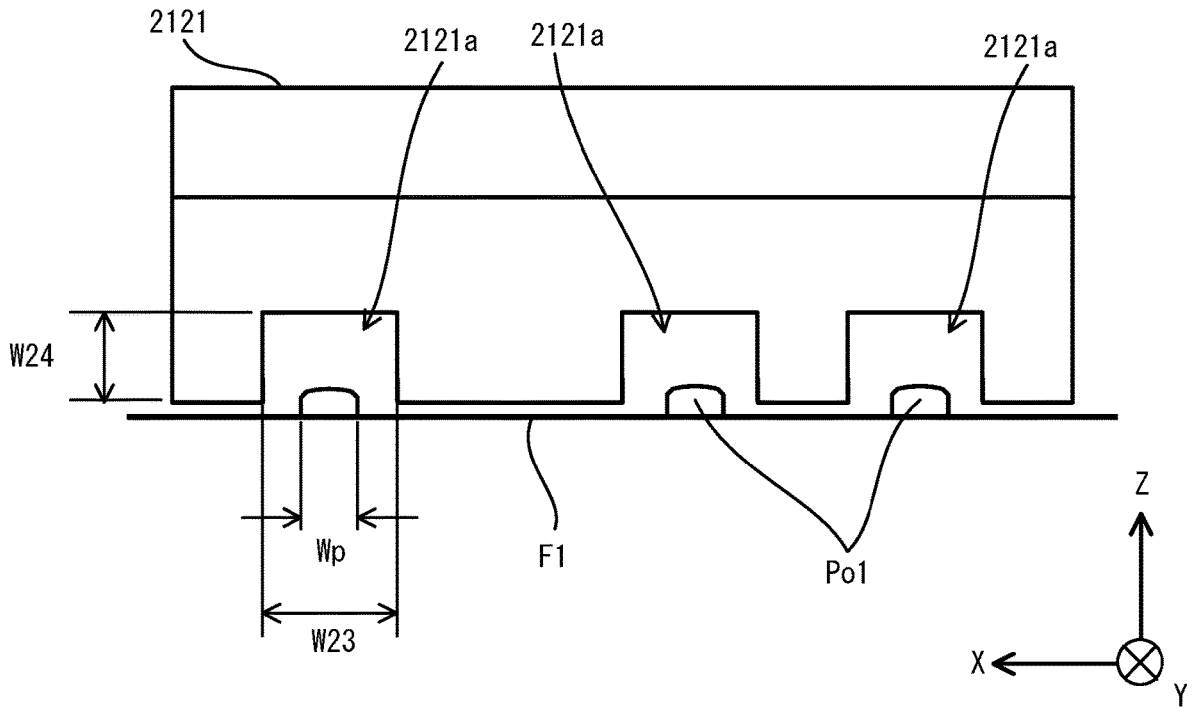
FIG. 8A is a side view of a part of the curl correcting device according to Embodiment 2.

For example, as illustrated in FIG. 7A, a pressing unit 2012 includes a base portion 2122; and one pressing member 2121 erectingly provided on the −Z direction side of the base portion 2122 such that the longitudinal direction thereof extends along the Z-axis direction. Here, the pressing unit 2012 presses, by the pressing member 2121, an area A2 illustrated in FIG. 7B, for example. Here, the area A2 is located between two mutually neighboring pockets Po1 in the Y-axis direction in the blister film F1, and corresponds to a second area including both end portions of the blister film F1 in the X-axis direction. As illustrated in FIG. 8A, in the pressing member 121, three recesses 2121*a* each having a rectangular shape as viewed from a direction along the Y-axis direction and penetrating the pressing member 2121 in the Y-axis direction are formed. Each recess 2121*a* is formed at a location corresponding to the pocket Po1 on the −Z direction side of the pressing member 121 in the state in which the blister film F1 is disposed on the −Z direction side of the pressing member 121. In addition, a width W23 in the X-axis direction of the recess 2121*a* is set to be greater than a width Wp in the X-axis direction of the pocket Po1. Besides, a depth W24 of the recess 2121*a* is set to be greater than a height Hp in the Z-axis direction of the pocket Po1 of the blister film F1. Furthermore, as illustrated in FIG. 7A, a thickness W21 of an end portion on the −Z direction side of the pressing member 2121 is set to be less than a distance Wip between mutually neighboring pockets Po1 in the Y-axis direction.

A film support unit 2013 includes a base portion 2132; and one support member 2131 erectingly provided such that the longitudinal direction thereof extends in the Z-axis direction on the +Z direction side of the base portion 2132. On the +Z direction side of the support member 2131, a groove 2131*a*, which extends in the X-axis direction and receives an end portion on the −Z direction side of the pressing members 2121, is formed. The support member 2131 supports the blister film F1 in the state in which portions on the Y direction sides of the groove 2131*a* are abutted on the −Z direction side of the blister film F1 on both sides of the area A2 pressed by the pressing member 2121 in the Y-axis direction of the blister film F1. A width W22 in the Y-axis direction of the groove 2131*a* is set to be greater than a width W21 of the end portion on the −Z direction side of the pressing member 2121 by at least a length corresponding to double the thickness of the blister film F1.

Figure 8B:
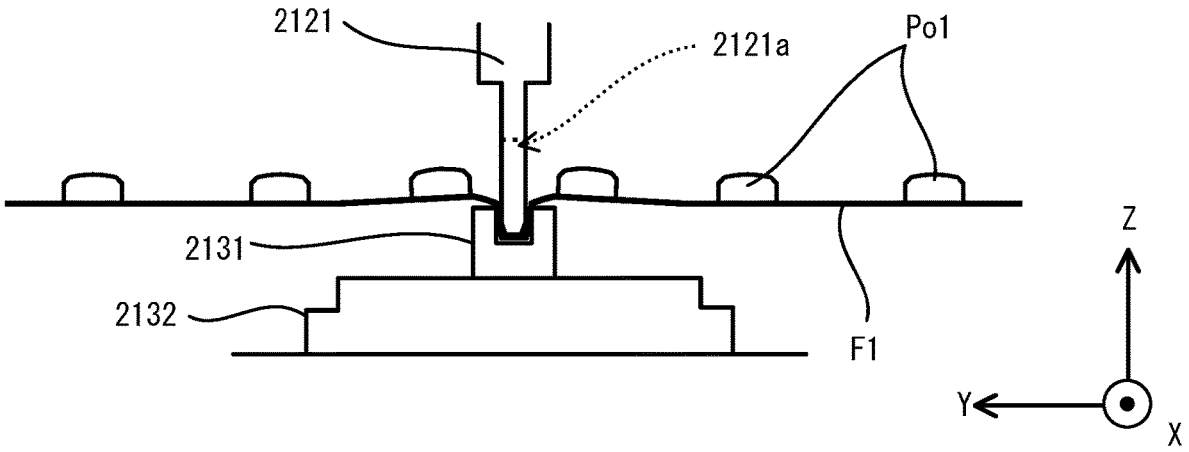
FIG. 8B is a front view illustrating a state in which a blister film is pressed by a pressing member in connection with the curl correcting device according to Embodiment 2.
Figure 8C:
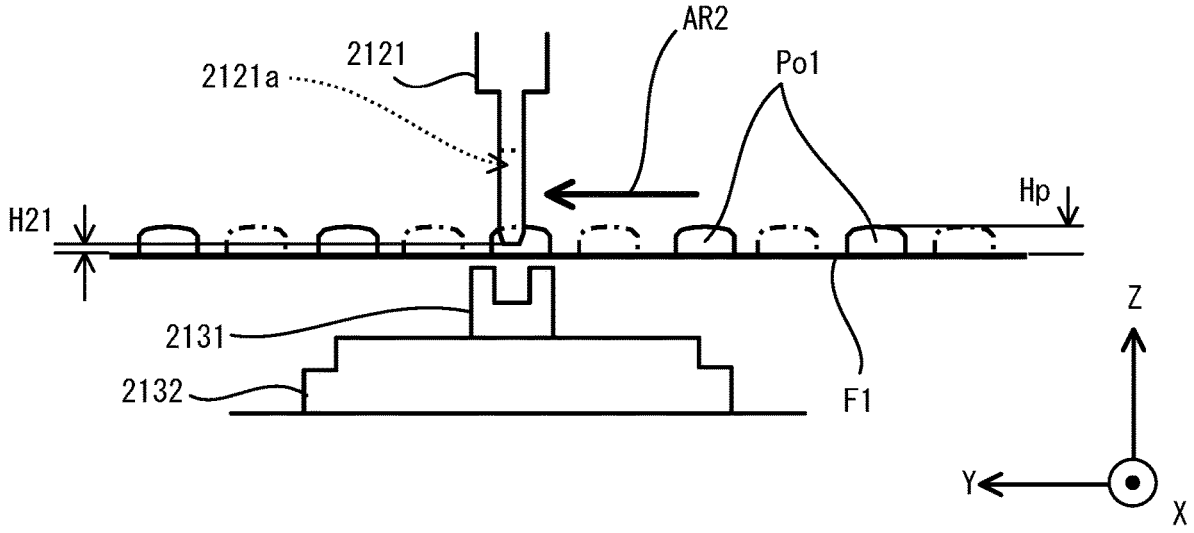
FIG. 8C is a front view illustrating a scene of conveying a blister film in connection with the curl correcting device according to Embodiment 2.

In the curl correcting device according to the present embodiment, to begin with, in the state in which the blister film F1 is placed on the +Z direction side of the support member 2131, the pressing member 2121 moves to the −Z direction side and approaches the support member 2131. Then, as illustrated in FIG. 8B, the end portion on the −Z direction side of the pressing member 2121 advances into a depth side of the groove 213Ta of the support member 2131, thereby pulling the blister film F1 into the inside of the groove 2131*a* of the support member 2131. Next, the pressing member 2121 is released from the blister film F1 by moving the pressing member 2121 in the +Z direction. At this time, as illustrated in FIG. 8C, a shortest distance H21 between the end portion on the −Z direction side of the pressing member 2121 and the blister film F1 is set to be less than the height Hp in the Z-axis direction of the pocket Po1. In this state, as indicated by an arrow AR2, the blister film F1 is conveyed in the +Y direction. At this time, the pocket Po1 passes through the inside of the recess 2121*a* of the pressing member 2121.

Figure 9A:
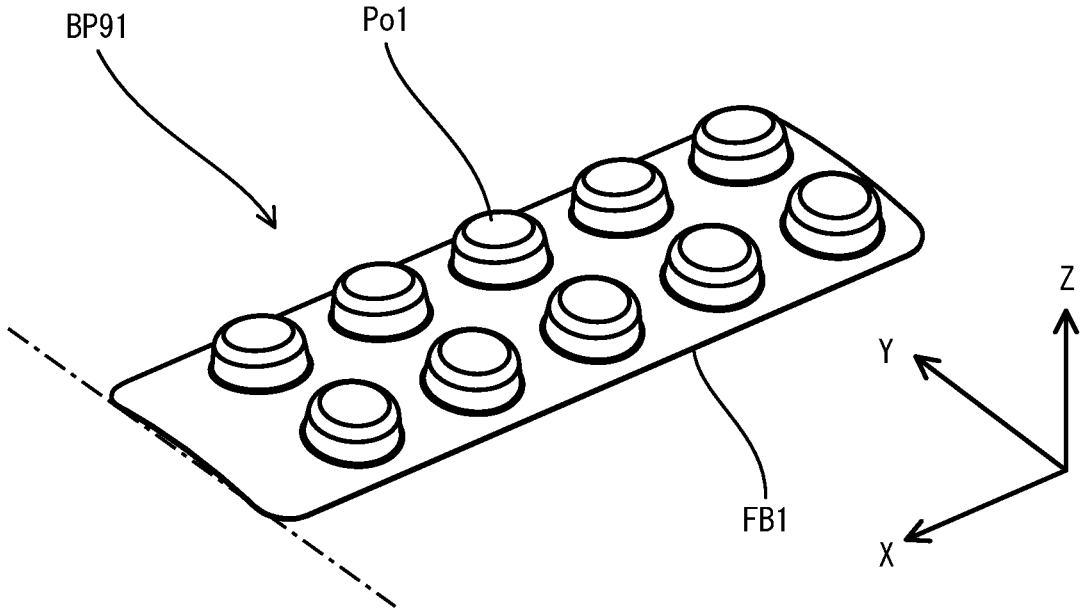
FIG. 9A is a perspective view illustrating an example of a blister pack.
Figure 9B:
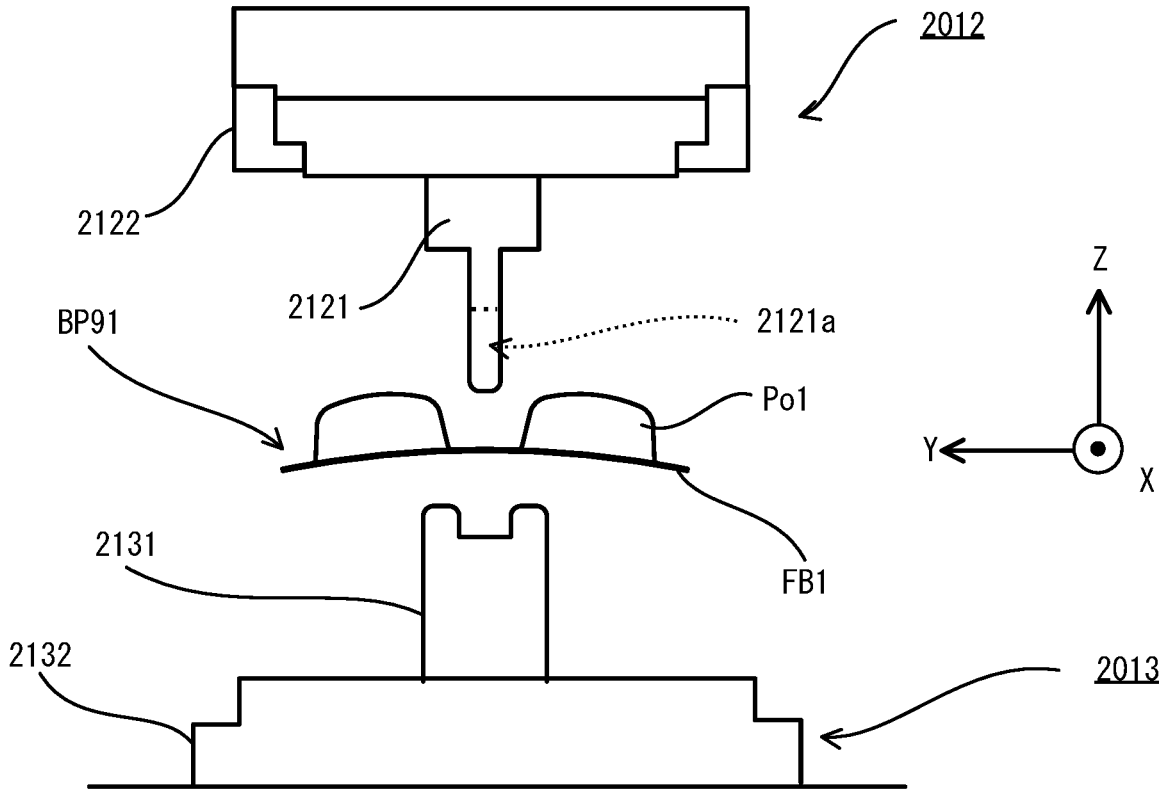
FIG. 9B is a front view of a part of the curl correcting device according to Embodiment 2.

In the meantime, when the blister film F1 is formed of a material with a high contractility, there is case where, for example, as in a state as illustrated in FIG. 9A, a film FB1 of a blister pack BP91 punched from the blister film F1 is curled such that a portion between two pockets Po1 in the Y-axis direction of the film FB1 protrudes most to the +Z direction side. In this case, for example, as illustrated in FIG. 9B, by the curl correcting device according to the present embodiment, in the state in which one blister pack BP91 is held, the portion between the two mutually neighboring pockets Po1 in the Y-axis direction in the film FB1 of the blister pack BP91 may be pressed by the pressing member 2121 toward the −Z direction. Thereby, the film FB1 is bent in a convex shape in a direction opposite to the direction of the protrusion due to the curl, and the curled state can be eliminated.

Figure 10:
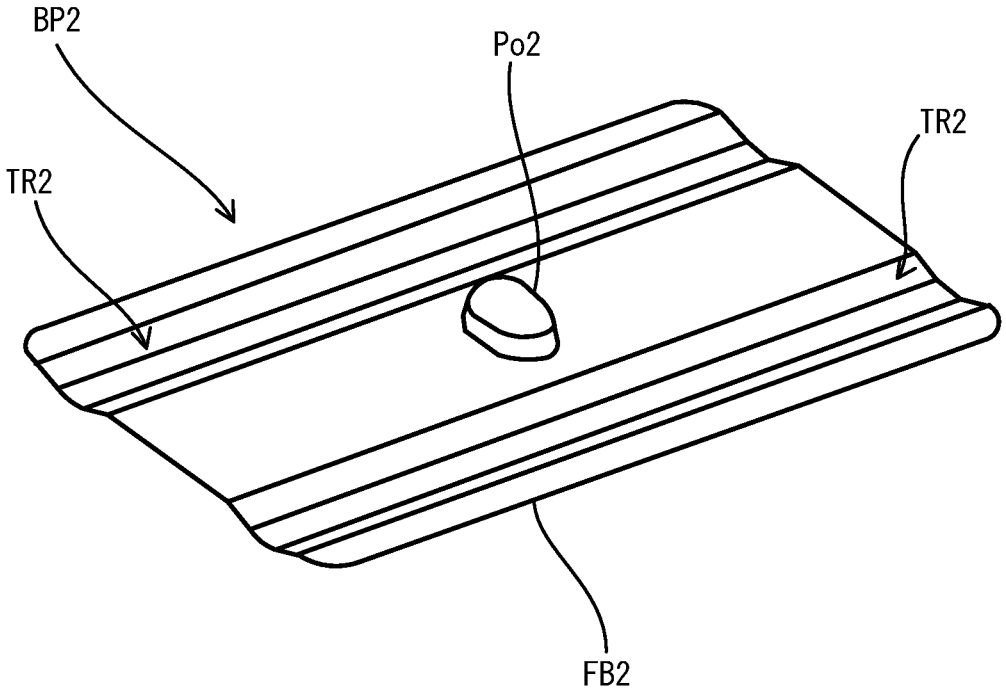
FIG. 10 is a perspective view of an example of a blister pack according to Embodiment 2.

In addition, for example, as illustrated in FIG. 10, the curl correcting device according to the present embodiment may be used to manufacture a blister pack BP2 in which grooves TR2 are formed on both sides of a pocket Po2 in a film FB2. In this case, the depth of the groove 2131*a* of the support member 2131 may be set to be such a depth that a groove is formed in the blister film F1.

As described above, also by the curl correcting device according to the present embodiment, while the curl curving along the X-axis direction, which occurs in the blister film F1, is eliminated, the throughput in the manufacture of blister packs using the blister packaging machine can be enhanced.

Figure 11:
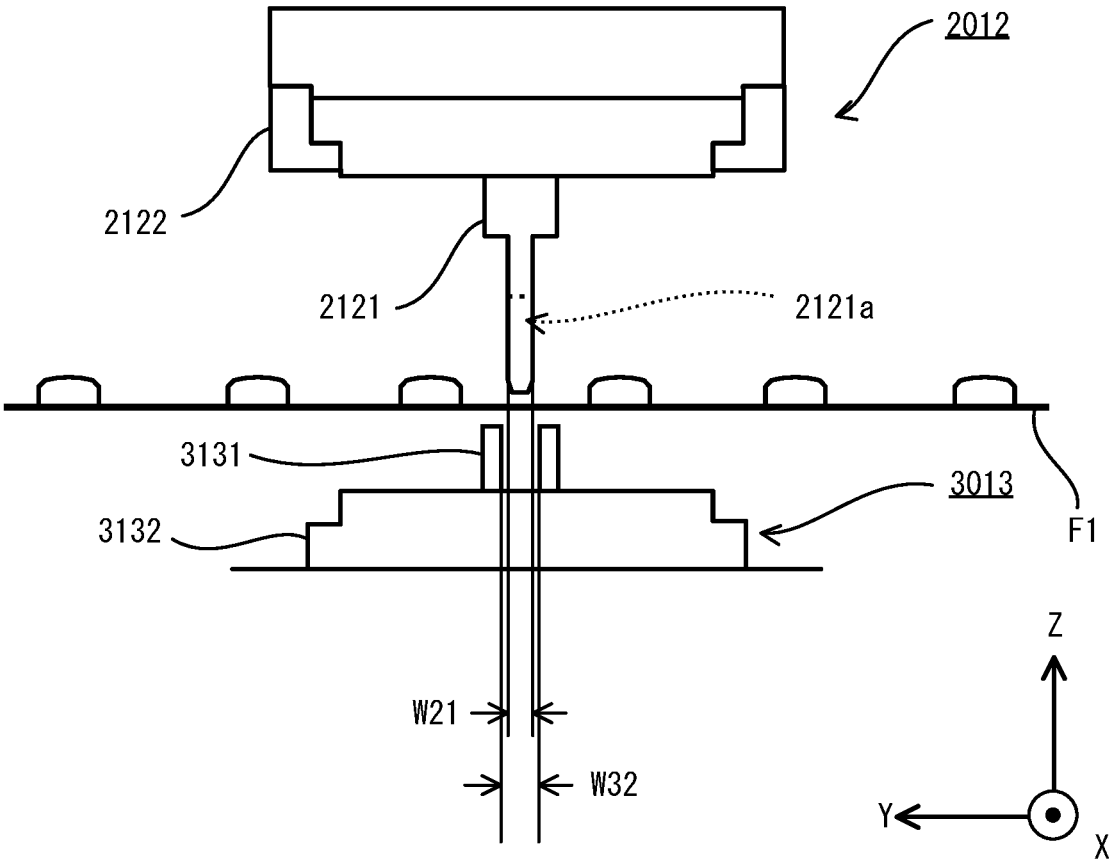
FIG. 11 is a front view of a part of a curl correcting device according to a modification.

The embodiments of the present disclosure have been described above, but the present disclosure is not limited to the structures of the above embodiments. For example, as illustrated in FIG. 11, a film support unit 3013 may include a base portion 3132 and two support members 3131 as illustrated in, for example, FIG. 11. Note that in FIG. 11, the same reference signs as in FIG. 7A are added to the same structural parts as in Embodiment 2 described above. Here, a distance W32 between the two support members 3131 in the Y-axis direction is variable. In addition, the base portion 3132 is provided with a support member driver (not illustrated) that drives the two support members 3131 in the Y-axis direction.

According to the present structure, the distance between the two support members 3131 can be adjusted to an optimal distance in accordance with the thickness of the distal end portion of the pressing member 2121.

In Embodiment 1, the example was described in which the pressing unit 12 includes the two pressing members 121, and presses two press locations of the blister film F1, which are arranged along the extending direction of the blister film F1. Aside from this, the pressing unit may include three or more pressing members, and may press three press locations of the blister film F1, which are arranged along the extending direction of the blister film F1.

In Embodiment 1, the example was described in which the pressing unit 12 includes the two pressing members 121, and the amount of pressing at the time of pressing the two press locations of the blister film F1, which are arranged along the extending direction of the blister film F1, is equal between the two press locations. Aside from this, the pressing unit may press the blister film F1 such that the amount of pressing on at least one press location among a plurality of press locations is different from the amount of pressing on another press location.

Figure 12A:
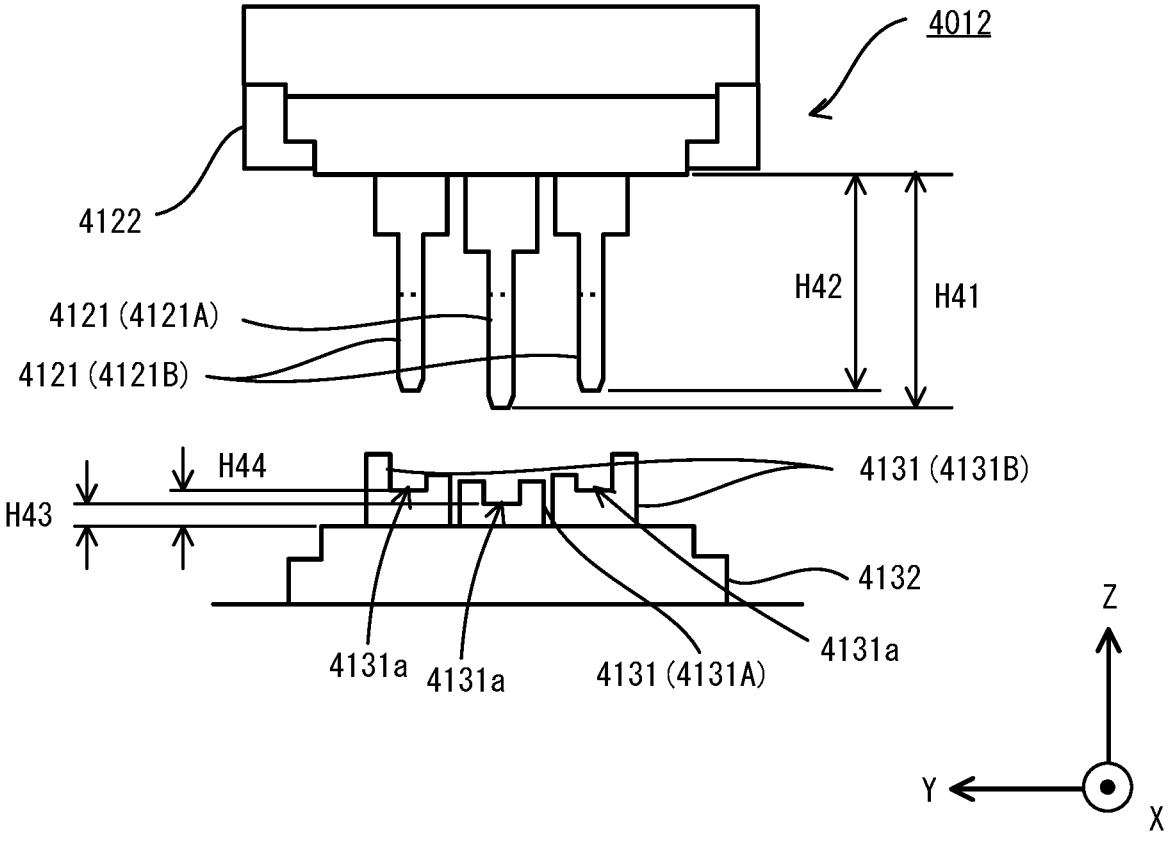
FIG. 12A is a front view of a part of a curl correcting device according to a modification.

For example, as illustrated in FIG. 12A, a pressing unit 4012 may include three pressing members 4121. In addition, a projection amount H41 of a pressing member 4121A, which is located at a central part in the Y-axis direction, from a base portion 4122 to the −Z direction may be greater than a projection amount H42 of each of pressing members 4121B, which are located on both end sides in the Y-axis direction. In this case, a film support unit 4013 may include three support members 4131 arranged at positions opposed to the three pressing members 4121 in the Z-axis direction. In addition, a height H43, from a base portion 4132, of the bottom of a groove 4131*a* of a support member 4131A located at a central part in the Y-axis direction may be lower than a height H44 of the bottom of each of grooves 4131*a* of support members 4131B located on both end sides in the Y-axis direction. In this case, the pressing unit 4012 presses the blister film F1 such that the amount of pressing on a central press location among three press locations is greater than the amount of pressing on each of the other two press locations.

Figure 12B:
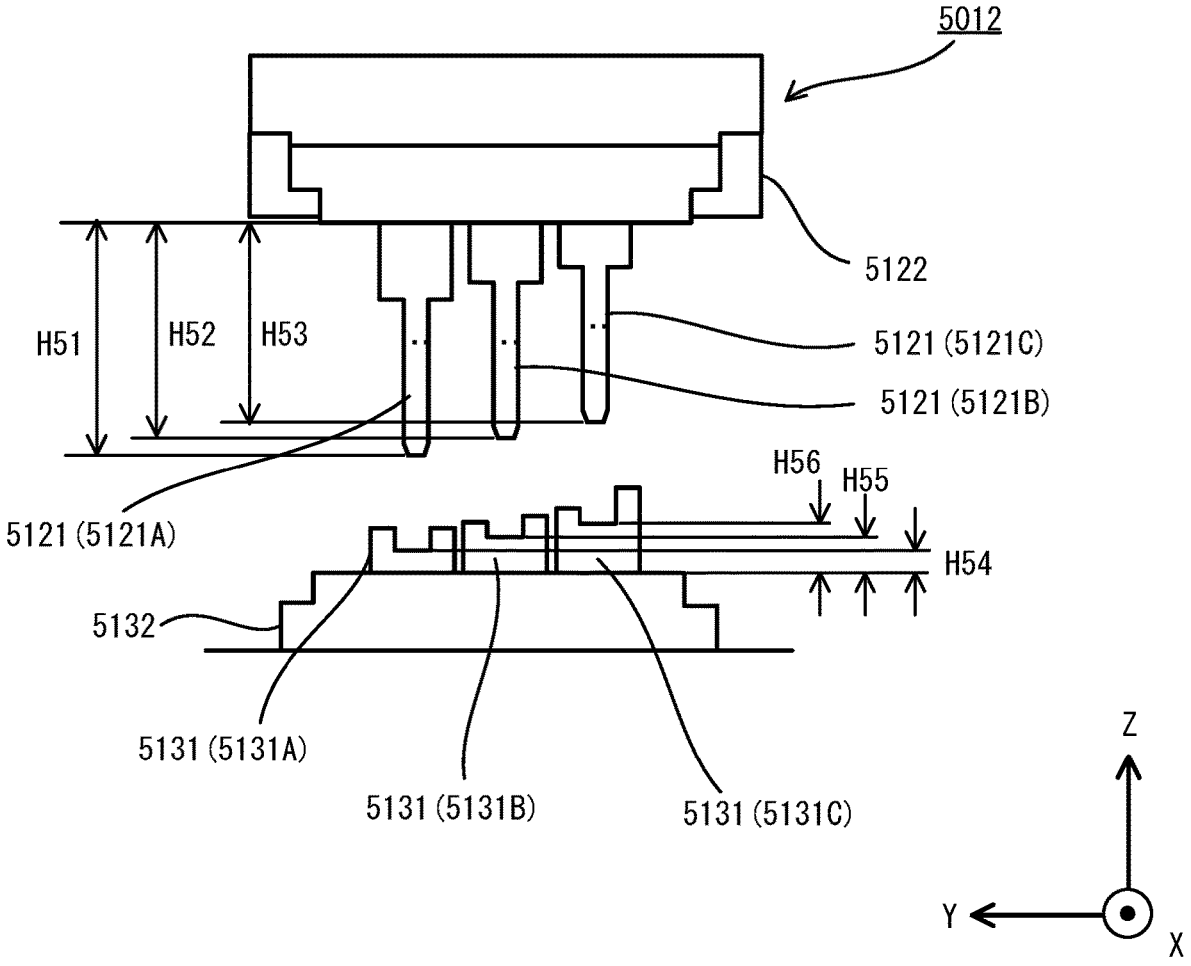
FIG. 12B is a front view of a part of a curl correcting device according to the modification.

Alternatively, for example, as illustrated in FIG. 12B, a projection amount H51 of a pressing member 5121A, which is located most to the +Y direction side among three pressing members 5121, from a base portion 5122 to the −Z direction may be greatest, and projection amounts H52 and H53 of pressing members 5121B and 5121C, which are located more to the −Y direction side than the pressing member 5121A, may become smaller toward the −Y direction side. In this case, in the film support unit 5013, a height H54, from a base portion 5132, of the bottom of a groove 5131*a* of a support member 5131A, which is located most to the +Y direction side among three support members 5131 may be lowest, and heights H55 and H56 of the bottoms of grooves 5131*a* of support members 5131B and 5131C, which are located more to the −Y direction side than the support member 5131A, may become greater toward the −Y direction side. In this case, a pressing unit 5012 presses the blister film F1 such that the amounts of pressing on the three press locations are different from each other.

According to these structures, the size and shape of the curl in the Y-axis direction, which is caused to occur in the blister film F1, can be adjusted.

In Embodiment 1, the example was described in which the pressing unit 12 presses the area A1 including pockets in the blister film F1 and including both end portions of the blister film F1 in the X-axis direction. Aside from this, the pressing unit 12 may press, for example, an area including only portions of pockets in the blister film F1 and including both end portions of the blister film F1 in the X-axis direction.

In the curl correcting device 1 according to Embodiment 1, the example was described in which the pressing unit 121 includes the two pressing members 121. Aside from this, the pressing unit 12 may include, for example, only one pressing unit 121, or may include three or more pressing units 121. Besides, in the curl correcting device according to Embodiment 2, the pressing unit 2012 may include a plurality of pressing 20 members 2121.

Figure 13A:
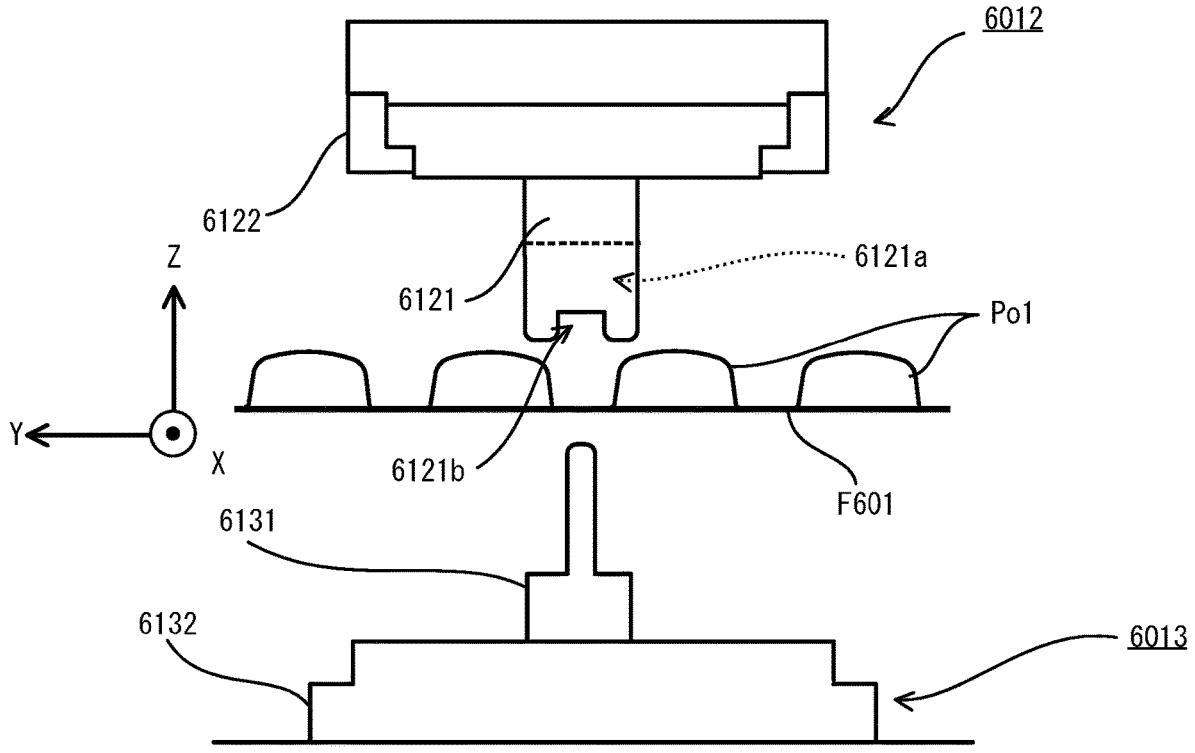
FIG. 13A is a front view of a part of a curl correcting device according to the modification.

In the curl correcting device according to Embodiment 2, for example, as illustrated in FIG. 13A, a film support unit 6013 may include a base portion 6132, and a support member 6131 including a plate-shaped distal end portion erectingly provided such that the longitudinal direction thereof extends in the Z-axis direction on the +Z direction side of the base portion 6132. In addition, a pressing unit 6012 may include a base portion 6122, and a pressing member 6121 erectingly provided on the −Z direction side of the base portion 6122 and including a distal end portion in which a groove 6121*b* and five recesses 6121*a* penetrating in the Y-axis direction are formed. Here, the five recesses penetrate the pressing member 6121 in the Y-axis direction, and are formed in positions corresponding to pockets Po1 on the −Z direction side of the pressing member 6121 in the state in which the blister film F1 is disposed on the −Z direction side of the pressing member 6121. In addition, the curl correcting device according to the present modification presses a portion between the two pockets Po1, which are arranged in the Y-axis direction in a blister film F601, by a distal end portion of the support member 6131 from the −Z direction side. Here, the blister film F601 has, for example, such a structure that five pockets Po1 are arranged in the width direction of the blister 10 film F601, that is, in the X-axis direction.

Figure 13B:
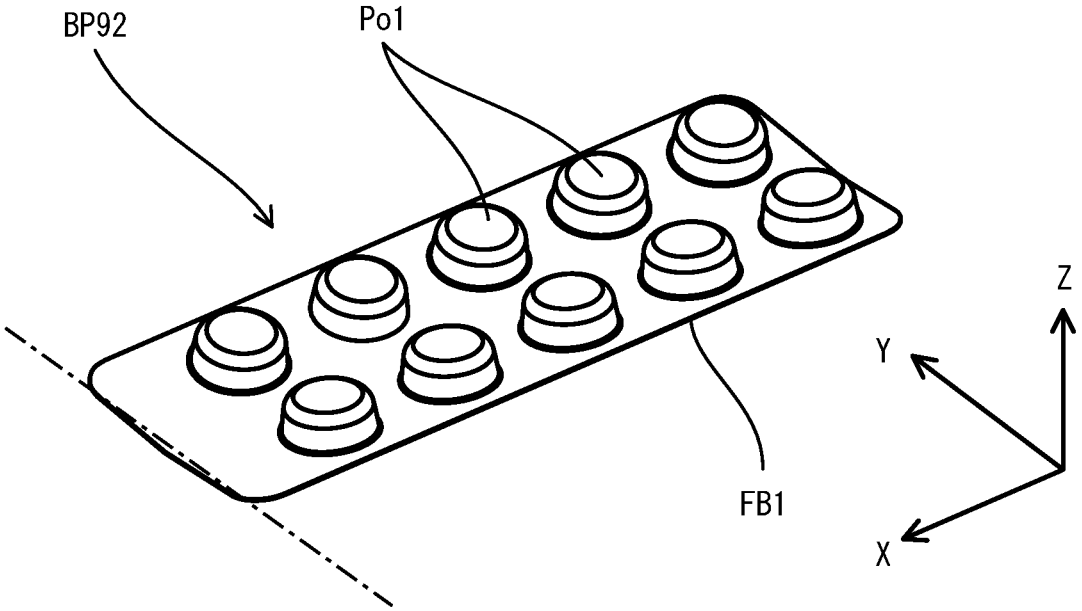
FIG. 13B is a perspective view illustrating an example of a blister pack.

In the meantime, when the blister film F601 is formed of a material with a high contractility, there is case where, for example, as in a state as illustrated in FIG. 13B, a film FB1 of a blister pack BP92 punched from the blister film F601 is curled such that a portion between two pockets Po1 in the Y-axis direction of the film FB1 protrudes most to the −Z direction side. In connection with this, according to the present structure, for example, as illustrated in FIG. 13A, the portion between the two pockets Po1 arranged in the Y-axis direction in the blister film F601 is pressed by the distal end portion of the support member 6131 from the −Z direction side, and thereby the curled state of the film FB1 can be eliminated.

Figure 14:
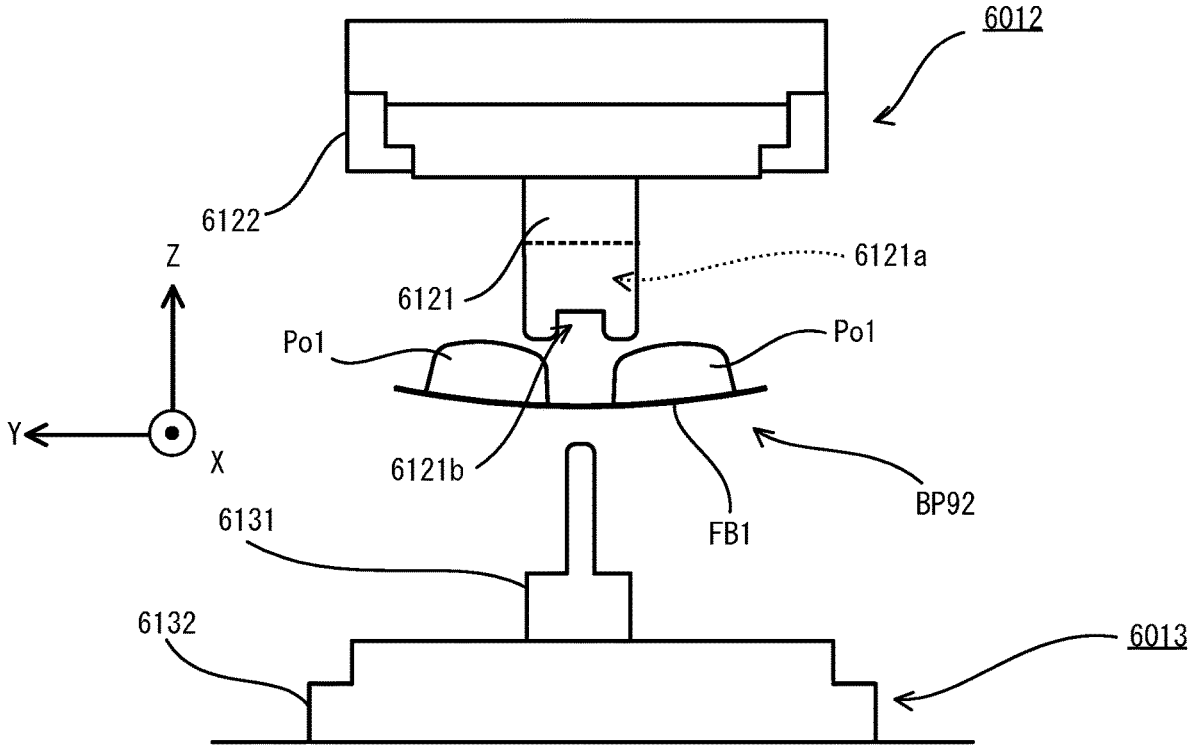
FIG. 14 is a front view of a part of a curl correcting device according to the modification.

In addition, for example, as illustrated in FIG. 14, by the curl correcting device according to the present modification, in the state in which one blister pack BP92 is held, the portion between the two pockets Po1 arranged in the Y-axis direction in the film FB1 of the blister pack BP92 may be pressed by the distal end portion of the support member 6131 from the −Z direction side toward the +Z direction. Thereby, the film FB1 is bent in a convex shape in a direction opposite to the direction of the protrusion due to the curl, and the curled state can be eliminated.

Figure 15A:
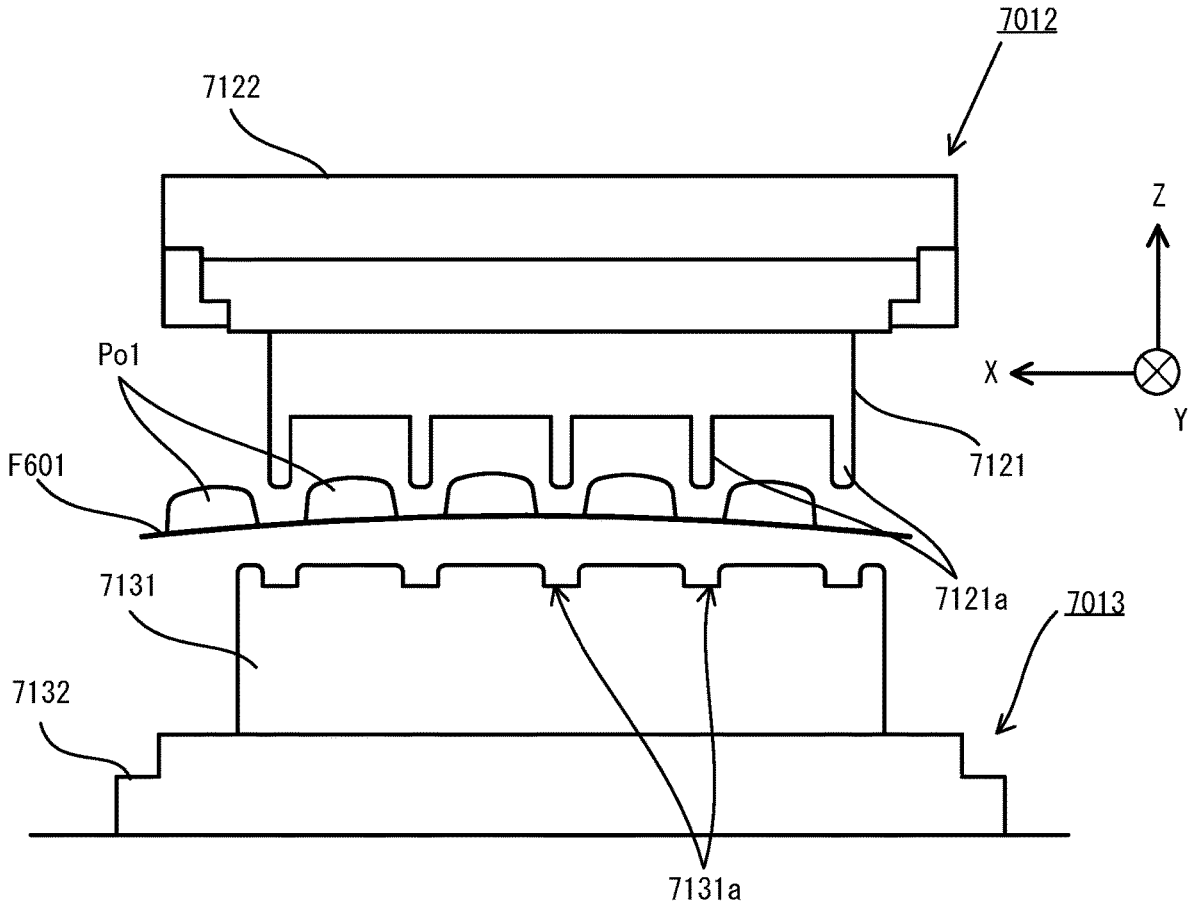
FIG. 15A is a front view of a part of a curl correcting device according to the modification.

In the curl correcting device according to Embodiment 2, for example, as illustrated in FIG. 15A, a film support unit 7013 may include a base portion 7132, and a support member 7131 erectingly provided such that the longitudinal direction thereof extends in the Z-axis direction on the +Z direction side of the base portion 7132, and including a distal end portion in which a plurality of (five in FIG. 15A) recesses 7131*a* arranged in the X-axis direction is provided. In addition, a pressing unit 7012 may include a base portion 7122, and a pressing member 7121 provided on the −Z direction side of the base portion 7122 and including a plurality of (five in FIG. 15A) plate-shaped pressers 7121*a*. Here, the curl correcting device according to the present modification presses portions between the five pockets Po1 arranged in the X-axis direction in the blister film F601 by distal end portions of the pressers 7121*a* of the pressing member 7121 from the +Z direction side toward the −Z direction.

Figure 15B:
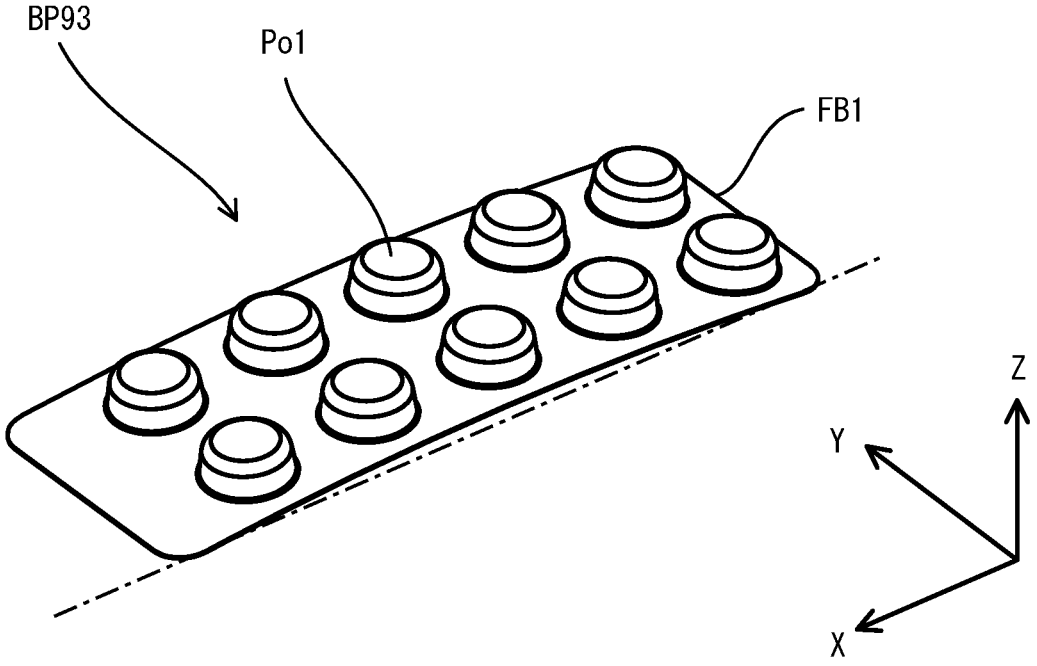
FIG. 15B is a perspective view illustrating an example of a blister pack.

In the meantime, when the blister film F601 is formed of a material with a high contractility, there is case where, for example, as in a state as illustrated in FIG. 15B, the entirety of a film FB1 of a blister pack BP93 punched from the blister film F601 is curled such that a central portion in the X-axis direction thereof protrudes most to the +Z direction side. In connection with this, according to the present structure, for example, as illustrated in FIG. 15A, the portions between the five pockets Po1 arranged in the X-axis direction in the blister film F601 are pressed by the distal end portions of the pressers 7121*a* of the pressing member 7121 from the +Z direction side toward the −Z direction, and thereby the curled state of the blister film F601 can be eliminated.

Figure 16A:
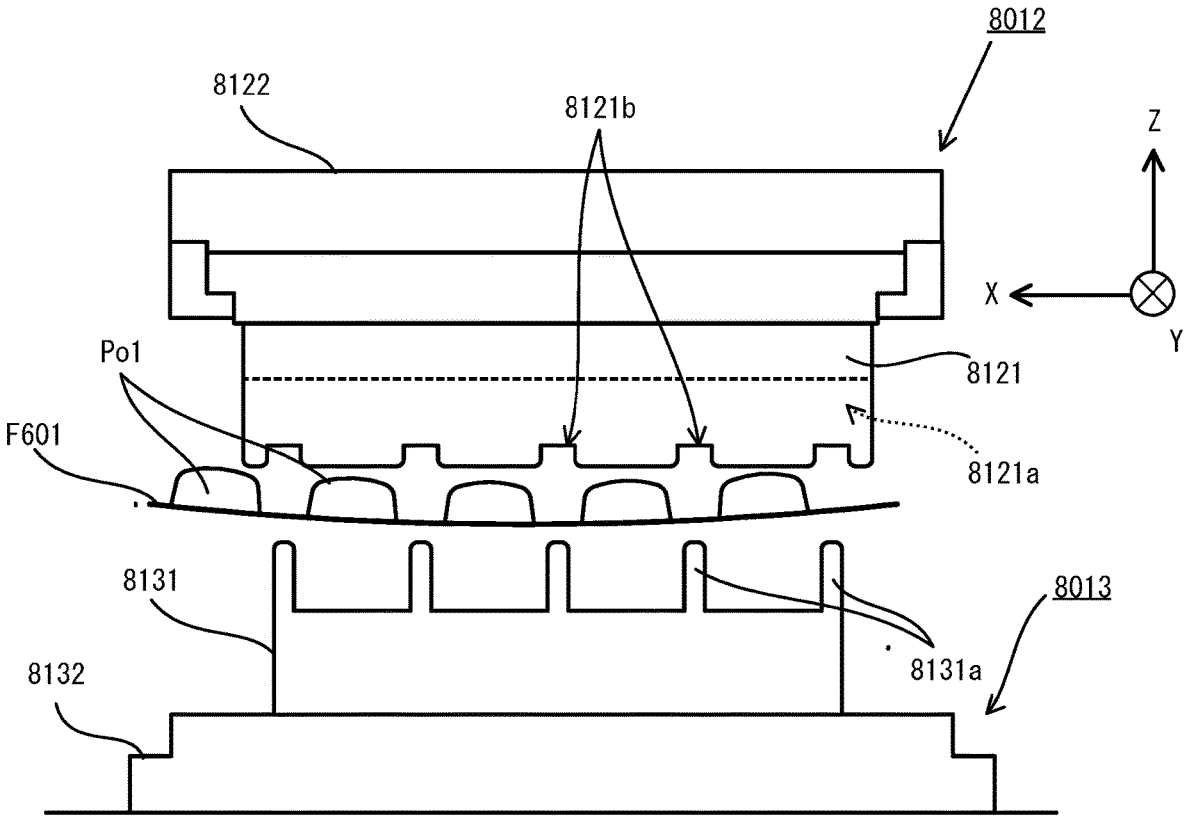
FIG. 16A is a front view of a part of a curl correcting device according to the modification.

In the curl correcting device according to Embodiment 2, for example, as illustrated in FIG. 16A, a film support unit 8013 may include a base portion 8132, and a support member 8131 erectingly provided such that the longitudinal direction thereof extends in the Z-axis direction on the +Z direction side of the base portion 8132, and including a plurality of (five in FIG. 15A) plate-shaped supporters 8131*a* that is erectingly provided such that the longitudinal direction thereof extends in the Z-axis direction on the +Z direction side of the base portion 8132. In addition, a pressing unit 8012 may include a base portion 8122, and a pressing member 8121 erectingly provided on the −Z direction side of the base portion 8122 and including a distal end portion in which a plurality of (five in FIG. 16A) grooves 8121*b* and a recess 8121*a* penetrating in the Y-axis direction are formed. Here, the curl correcting device according to the present modification presses portions between the five pockets Po1 arranged in the X-axis direction in the film FB1 of the blister pack BP92 by distal end portions of the supporters 813Ta of the support member 8131 from the −Z direction side toward the +Z direction.

Figure 16B:
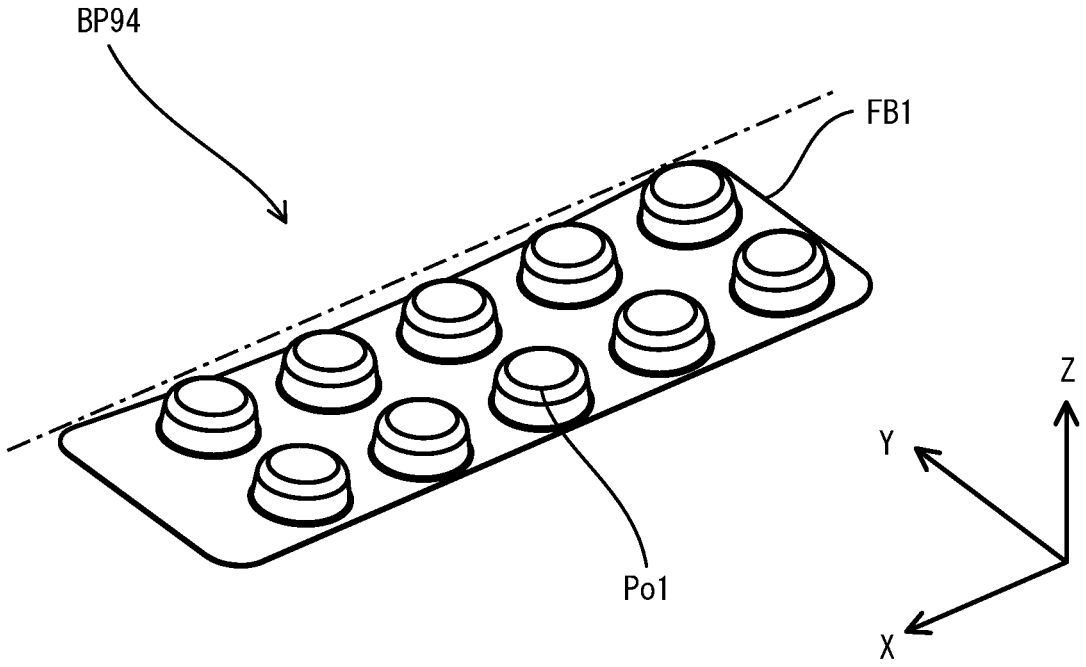
FIG. 16B is a perspective view illustrating an example of a blister pack.

In the meantime, when the blister film F601 is formed of a material with a high contractility, there is case where, for example, as in a state as illustrated in FIG. 16B, the entirety of a film FB1 of a blister pack BP94 punched from the blister film F601 is curled such that a central portion in the X-axis direction thereof protrudes most to the −Z direction side. In connection with this, according to the present structure, for example, as illustrated in FIG. 16A, the portions between the five pockets Po1 arranged in the X-axis direction in the film FB1 of the blister pack BP94 are pressed by the distal end portions of the supporters 8131*a* of the support member 8131 from the −Z direction side toward the +Z direction, and thereby the curled state of the blister film F601 can be eliminated.

In the present embodiment, the blister packaging machine may include a position changing mechanism that changes a relative position of the curl correcting device 1 to the punching device 3. A relative position changer may be, for example, an LM guide, and may include a rail extending in the Y-axis direction, and a slider block that supports the device body 11 of the curl correcting device 1 and slides on the rail. Here, the position changing mechanism changes the relative position of the curl correcting device 1 to the punching device 3 by changing the distance between the slider block and the punching device 3. Alternatively, in the present embodiment, the curl correcting device 1 may be detachable from the blister packaging machine, and may be capable of freely changing the position of installation within the blister packaging machine.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to betaken in a limiting sense, and the scope of the invention is defined only by the included claims, along with the full range of equivalents to which such claims are entitled.

This application claims the benefit of Japanese Patent Application No. 2020-008517, filed on Jan. 22, 2020, the entire disclosure of which is incorporated by reference herein.

INDUSTRIAL APPLICABILITY

The present disclosure is suitable in the manufacture of a PTP film for packaging a tablet, medical equipment, or the like.

REFERENCE SIGNS LIST

1 Curl correcting device
2 Convey device
3 Punching device
11,31 Device body
12, 2012, 4012, 5012, 6012, 7012, 8012 Pressing unit
13, 2013, 3013, 4013, 5013, 6013, 7013, 8013 Film support unit
14 Driver
15, 421 Guide roller
16, 123, 133 Fixing member
17 Transmission member
19, 422 Roller supporter
21 Film feed roller
22 Roller driver
32 Punch unit
33 Die unit
34 Die driver
41 Film presser
111*a* Base member
111*b*, 111*c*, 111*d* Side wall
111*e* Cover
112 Guide block
113 Bearing supporter
114 Driver supporter
121, 2121, 4121, 5121 Pressing member
121*a*, 211*a*, 2121*a*, 6121*a*, 8121*a* Recess
121*b* Flat portion
121*c* Curved portion
122, 132, 2122, 2132, 3132, 4122, 4132, 5132, 6132, 7132, 8132 Base portion
131, 2131, 3131, 4131, 5131, 6131, 7131, 8131 Support member
131*a*, 2131*a*, 4131*a*, 5131*a*, 6121*b*, 7131*a*, 8121*b*, TR2 Groove
141 Motor
142 Coupling member
143,212 Shaft
145 Cam
151 Bearing
171 Main body
172 Bearing supporter
173 Bearing
174 Guide bar
174*a* Stopper
181 Coil spring
211 Wheel
371,411 Roller
372 Film position restriction member
412 Arm
7121*a* Presser
8131*a* Supporter
A1, A2 Area
BP, BP2 Blister pack
F1, F601 Blister film
Po1, Po2 Pocket

The invention claimed is:

1. A curl correcting device that corrects a curl occurring in a blister film with a strip shape, pockets for accommodating works being formed in the blister film and being arranged in a first direction along an extending direction of the blister film, the curl correcting device comprising:

a pressing unit disposed on one surface side in a thickness direction of the blister film, and pressing, by a pressing member, only at least one-a first area or at least one second area, the at least one first area including at least a part of the pockets in the blister film, having a width in the first direction that is less than a distance between center axes, of two mutually neighboring pockets in the first direction, along the thickness direction of the blister film, and including both end portions of the blister film in a second direction perpendicular to the first direction and the thickness direction of the blister film, the at least one second area located between two mutually neighboring pockets in the first direction in the blister film, having a width in the first direction that is less than a distance between center axes, of two mutually neighboring pockets in the first direction, along the thickness direction of the blister film, and including both end portions of the blister film in the second direction; and a support member in a state of supporting the blister film with the support member abutting only on the other surface side that is on a side opposite the one surface side in the thickness direction of the blister film on both sides of the at least one first area or the at least one second area pressed, upon the blister film being pressed by the pressing member, by the pressing member in the first direction of the blister film, wherein a recess having a width in the second direction greater than a width in the second direction of the pocket and penetrating the pressing member in the first direction is formed at a location corresponding to the pocket on the blister film side of the pressing member, and when the blister film is conveyed, a shortest distance between an end portion on the blister film side in the pressing member and the blister film is less than a height of the pocket in the thickness direction of the blister film.

2. The curl correcting device according to claim 1, wherein the pressing member has a plate shape and presses the first area, and the recess has a rectangular shape as viewed from a direction along the first direction, and has a depth greater than a height of the pocket in the thickness direction of the blister film.

3. The curl correcting device according to claim 2, wherein the pressing unit presses a plurality of press locations arranged in the extending direction in the blister film.

4. The curl correcting device according to claim 3, wherein the pressing unit presses the blister film such that an amount of pressing on at least one press location among the plurality of press locations is different from an amount of pressing on another press location.

5. The curl correcting device according to claim 2, wherein the pressing unit presses a plurality of press locations arranged in the extending direction in the blister film.

6. The curl correcting device according to claim 5, wherein the pressing unit presses the blister film such that an amount of pressing on at least one press location among the plurality of press locations is different from an amount of pressing on another press location.

7. The curl correcting device according to claim 1, wherein the pressing unit presses a plurality of press locations arranged in the extending direction in the blister film.

8. The curl correcting device according to claim 7, wherein the pressing unit presses the blister film such that an amount of pressing on at least one press location among the plurality of press locations is different from an amount of pressing on another press location.

9. The curl correcting device according to claim 1, wherein the pressing unit presses a plurality of press locations arranged in the extending direction in the blister film.

10. The curl correcting device according to claim 9, wherein the pressing unit presses the blister film such that an amount of pressing on at least one press location among the plurality of press locations is different from an amount of pressing on another press location.

11. A blister packaging machine comprising:

a curl correcting device that corrects a curl occurring in a blister film with a strip shape, pockets for accommodating works being formed in the blister film and being arranged in a first direction along an extending direction of the blister film; and a punching device punching a blister pack from the blister film;

wherein the curl correcting device comprises:

a pressing unit disposed on one surface side in a thickness direction of the blister film, and pressing, by a pressing member, only at least one first area or only at least one second area, the at least one first area including at least a part of the pockets in the blister film, having a width in the first direction that is less than a distance between center axes, of two mutually neighboring pockets in the first direction, along the thickness direction of the blister film, and including both end portions of the blister film in a second direction perpendicular to the first direction and the thickness direction of the blister film, the at least one second area located between two mutually neighboring pockets in the first direction in the blister film, having a width in the first direction that is less than a distance between center axes, of two mutually neighboring pockets in the first direction, along the thickness direction of the blister film, and including both end portions of the blister film in the second direction; and a support member supporting the blister film in a state of abutting on the other surface side that is on a side opposite the one surface side in the thickness direction of the blister film on both sides of the at least one first area or the at least one second area pressed by the pressing member in the first direction of the blister film, a recess having a width in the second direction greater than a width in the second direction of the pocket and penetrating the pressing member in the first direction is formed at a location corresponding to the pocket on the blister film side of the pressing member, and when the blister film is conveyed, a shortest distance between an end portion on the blister film side in the pressing member and the blister film is less than a height of the pocket in the thickness direction of the blister film.

12. The blister packaging machine according to claim 11, wherein the pressing unit presses a plurality of press locations arranged in the extending direction in the blister film.

13. The blister packaging machine according to claim 12, wherein the pressing unit presses the blister film such that an amount of pressing on at least one press location among the plurality of press locations is different from an amount of pressing on another press location.

* * * * *